United States Patent [19]

Cooper

[11] Patent Number: 5,052,569

[45] Date of Patent: Oct. 1, 1991

[54] SAFETY ENCLOSURE FOR STORING CONTAINERS OF HAZARDOUS MATERIAL

[76] Inventor: Clinton T. Cooper, 105 Overhill Rd., Youngstown, Ohio 44512

[21] Appl. No.: 656,645

[22] Filed: Feb. 19, 1991

[51] Int. Cl.[5] ..... B65D 7/26

[52] U.S. Cl. ..... 220/1.5; 220/688; 220/692

[58] Field of Search ..... 220/1.5, 585, 4.28, 220/433, 43.4, 4.16, 677, 680, 682, 684, 685, 689, 692, 693; 206/599, 600; 49/168, 171; 82/397

[56] References Cited

U.S. PATENT DOCUMENTS

| | | | |
|---|---|---|---|
| 2,737,266 | 3/1956 | Gross | 220/622 |
| 4,627,549 | 12/1986 | Dudding | 220/1.5 |
| 4,858,779 | 8/1989 | Zimmgriund | 220/1.5 |
| 4,887,731 | 12/1989 | Pett et al. | 220/1.5 |
| 4,936,477 | 6/1990 | King et al. | 82/397 |

*Primary Examiner*—Joseph M. Moy
*Attorney, Agent, or Firm*—David A. Burge

[57] ABSTRACT

A safety storage enclosure for housing containers of hazardous material is formed using wall components that have complementary edge formations that extend vertically and connect with elongate framing members to provide post-like supports. The wall components connect at their lower end regions with a welded, generally rectangular base assembly, and at their upper end regions with a correspondingly configured roof assembly, with the post-like supports strengthening the enclosure by providing rigid, columnar structures that extend from the base to the roof assembly. Front, back and opposed end walls of a variety of lengths can be formed using selected sets of "standard" wall panels and wall-corner panels, and "door panels" can be substituted for selected wall panels. Framing members of a variety of types are removably and replaceably mounted in inwardly-facing recesses that are defined at junctures of abutting edge formations of adjacent wall and/or wall-corner panels, including framing members that are configured to cooperate with fasteners to adjustably position shelf brackets and the like. A removable grate-like floor fully spans the interior of the enclosure. One or more sumps underlies substantially the entire area of the floor to catch spillage and leakage, with the sumps being elevated so their integrity can be visually checked.

58 Claims, 14 Drawing Sheets

SAFETY ENCLOSURE FOR STORING CONTAINERS OF HAZARDOUS MATERIAL

BACKGROUND OF THE INVENTION

1. Field of the Invention

The present invention relates to safety enclosures of the type that increasingly are being referred to as "secondary containment buildings," namely walk-in storage structures that have walls and roofs that typically are formed from metal, that typically are used to store containers of "hazardous materials" such as cans of paint, drums of lubricant and the like, and that customarily are provided with sump-type "secondary containment" vessels into which spillage and leakage are directed for temporary collection and safe disposal. More particularly, the present invention relates to safety enclosures of modular construction that preferably employ wall panels and other components and assemblies that are protectively coated prior to final assembly, with wall panel components having complementary edge formations that extend vertically and connect with recess-carried framing members that rigidify and strengthen the walls of the resulting structures as well as providing columnar-like supports that extend between the base and roof assemblies, with the wall components and framing members preferably being bolted together to effect final assembly either at a factory or at sites where the enclosures are to be installed.

2. Prior Art

Increased emphasis is being placed on the importance of assuring that solvents, lubricants, paint related products and the like are handled and stored with adequate safeguards. Increasingly it is being recognized that even small spills and relatively minute leakages of the growing number of substances that are being referred to by the term "hazardous material" easily can detrimentally affect persons, property, plants, animals, ground water and other aspects of ecology and environment. Moreover, in view of increasing concern about the lasting nature of the adverse effects that can result from spills and unchecked leakage of hazardous material, these topics are receiving increasing attention by law-makers, by regulating agencies, and by those who have been elected to govern and to enforce laws and regulations.

In circumstances of heightened awareness and concern such as are described above, it is inevitable that those who have responsibility for the safe handling and/or storage of "hazardous materials" are being called upon to use only such equipment and techniques as have been duly "approved" and "tested" to assure that even small, inadvertent "spills" are contained, and that container leakage is caught, collected and confined until its cause can be ascertained and corrected, and until the leaked material can be processed for safe disposal. The use of safety enclosures that provide "secondary containment" increasingly is becoming mandatory for storing even relatively small quantities of solvent, paint, lubricants and the like, even in small businesses such as garages, repair shops, and the like.

While a number of proposals have been made in efforts to provide a variety of types of "secondary containment buildings," prior proposals have been characterized by a number of drawbacks, whereby the need for well-designed, versatile, multi-use safety enclosures continues to grow.

One drawback that has characterized many prior proposals for safety enclosures has been the need for structures that feature strong walls which provide easy-to-use connection points for mounting shelf brackets and other needed items such as electrical conduits and fixtures for hazardous-environment lighting, pipes and heads for sprinkler systems, and the like. It has proven not to be enough to simply provide a safety enclosure that has simply a strong floor, atop which containers can be positioned for storage. Rather, in addition to providing a strong floor, today's safety storage enclosure needs to provide strong walls having conveniently located, easy- to-use connection points for mounting shelf brackets and other devices at eye-level and at other suitable heights above the surface of the floor.

Versatility is needed in today's safety enclosure so that the needs that it has been purchased to immediately address can be well served, but also so that the unanticipated needs of tomorrow likewise can be accommodated to the fullest possible extent. Often a safety enclosure that has been purchased for resolving a first type of storage problem at a first location gets "passed down" for use in resolving a very different second type of storage problem at a second location. Frequently, this happens when a different, typically larger enclosure eventually is needed to again address the first problem at the first location. Longevity of service life, and a capability to be transported from place to place without likelihood of incurring damage during transport also are characteristics that are needed so that, as the character of the need for a safety enclosure at a particular location changes, the safety enclosure that already is installed there can be "passed down" to another department or sold to a new owner, whereby a full and appropriate measure of value and service can be gotten from the product. Many of the prior proposals for safety enclosures do not provide desirably long-lived, strong and portable units that permit their being successively redeployed during lengthy service lives.

Modularity and scaleability of product design also tend to be lacking in many prior proposals. Rather than to use combinations of modular bolt-together wall panels and wall-corner panels (together with "door panels" that can be substituted as needed for selected wall panels), many prior proposals use welded together, specially configured, non-modular components that are specially made for use in forming only one or a very limited number of sizes of safety enclosures.

In order for a wide range of safety enclosure sizes and capacities to be offered by any one manufacturer, the use of sets of "standardized" components that can be connected quite simply and securely by bolting them together is desirable. However, the safety enclosures of many prior proposals do not utilize and are not well adapted to utilize "standardized" components; and, in many instances, the strength of the resulting enclosures would be significantly diminished if reasonably priced, easily implemented fastening techniques (such as the use of threaded fasteners) were substituted for welding.

Even the character of the "secondary containment vessels" or "sumps" that are provided in many previously proposed safety enclosures leaves a great deal to be desired. Often, the sumps that have been provided by the manufacturers have a lesser total capacity (in comparison with the combined capacities of the containers that are intended to be stored within the enclosures) than is desired. If the sumps do not have a capacity to contain at least about twenty five percent of the combined capacities of the containers that are housed within the their associated enclosures, there is a danger that the level of protection that is afforded by the "secondary containment" will fail to meet needs that a particular enclosure quite likely may encounter during the course of a reasonable service life.

For these and other reasons, there remains a very genuine and real need for well-designed, heavy-duty, secondary containment enclosures that appropriately address today's increasing concern for the way in which "hazardous materials" are stored. Likewise, there remains a need for high quality safety enclosures that are of adequately versatile construction to permit their being suitably "passed down" from one form of service to another during the course of a reasonably lengthy service life.

SUMMARY OF THE INVENTION

The present invention addresses the foregoing and other needs by providing a safety storage enclosure of the type that includes one or more secondary containment sumps, with the wall components, base and roof assemblies thereof being pre-finished and being capable of being final-assembled either at a factory or at an installation site as by bolting the components together to provide a strong, heavy-duty product that will provide good service life and, under circumstances of reasonable use, can be moved from site to site over the years as may be appropriate to address a series of differing service needs.

In preferred practice, a safety storage enclosure for housing containers of hazardous material is formed using wall components that have complementary edge formations that extend vertically and connect with elongate framing members to provide post-like supports. The wall components connect at their lower end regions with a welded, generally rectangular base assembly, and at their assembly. The post-like supports are provided at relatively closely spaced intervals about the perimeter of the enclosure to strengthen the enclosure by providing rigid, columnar structures that extend the full distance from the base assembly to the roof assembly.

In preferred practice, framing members of a variety of types are removably and replaceably mounted in inwardly-facing recesses that are defined at junctures of abutting edge formations of adjacent wall and/or wall-corner panels. The variety of framing members includes framing members that cooperate with central portions of a pair of adjacent wall and/or wall-corner panels to provide relatively smooth-faced connections therebetween; and, framing members that are configured to cooperate with fasteners to adjustably position shelf brackets and the like.

In preferred practice, a removable grate-like floor fully spans the interior of the enclosure so as to extend from front-to-rear and from end-to-end thereof, with the floor overlying one or more secondary containment sumps. The secondary containment sumps preferably are arranged to substantially fill a central containment region of the base assembly that is protectively shrouded and perimetrically surrounded by a generally rectangular frame formed from structural steel.

In preferred practice, the containment sumps preferably are supported at a level that is raised from the bottom of the base assembly so that the structure of these sumps can be viewed from outside of the enclosure to permit periodic visual checks to be made of the integrity of the sumps. Moreover, in preferred practice, relatively large, deep containment sumps are used that are intended to contain as much as twenty five percent of the capacity of such containers as are stored within the enclosure.

In preferred practice, each of the opposed, vertically extending edges of each of the wall and wall-corner panels defines a substantially J-shaped edge formation that is abuttingly joined in a novel and improved way with a complementary J-shaped edge formation of an adjacent one of the wall and/or wall-corner panels, as will be described more fully later herein. The "double-J" mating type of edge formation engagement that is used in accordance with the preferred practice of the present invention offers a number of advantages in that it defines an inwardly facing recess into which a framing member can be inserted to bridge the juncture between the two edge formations. In preferred practice, aligned holes are formed through the J-shaped edge formations and through framing members installed in the inwardly-facing recess, and threaded fasteners such as bolts are inserted through the holes and clamped in place to provide secure connections between adjacent wall panels and to so strengthen the regions of these junctures as to effectively enable them to serve as support columns that rest on the base and extend vertically to support the roof at closely spaced intervals about the periphery of the enclosure.

In preferred practice, selected ones of the framing members are of a type that defines an inwardly facing "track" or "mounting groove" that can receive threaded fasteners such as nuts, into which threaded fasteners such as bolts can be installed to clamp shelf brackets and the like in place at selected wall locations.

In preferred practice, a welded roof assembly is configured so that it properly cooperates with the base assembly to receive upper and lower end regions of the wall, wall-corner and door panels. Like the welded base assembly, the welded roof assembly preferably is factory-finished with protective coating material before it is assembled either at the factory or at an installation site with the various panels that form the walls.

In preferred practice, "door panels" (i.e., door frame assemblies) are provided that are substitutable for selected ones of the wall panels so that one or more doors can be provided in an enclosure as may be appropriate in order to accommodate the needs that are to be serviced by a particular enclosure.

Other features that are embodied in the preferred practice of the present invention have to do with the "standard" types of wall panels and "standard" types of wall-corner panels are employed in order to form building structures in a modular and versatile way that will accommodate base and roof structures chosen from a wide range of possible sizes and capacities.

BRIEF DESCRIPTION OF THE DRAWINGS

These and other features, and a fuller understanding of the invention may be had by referring to the following description and claims, taken in conjunction with the accompanying drawings, wherein:

DESCRIPTION OF THE PREFERRED EMBODIMENT

Figure 1:
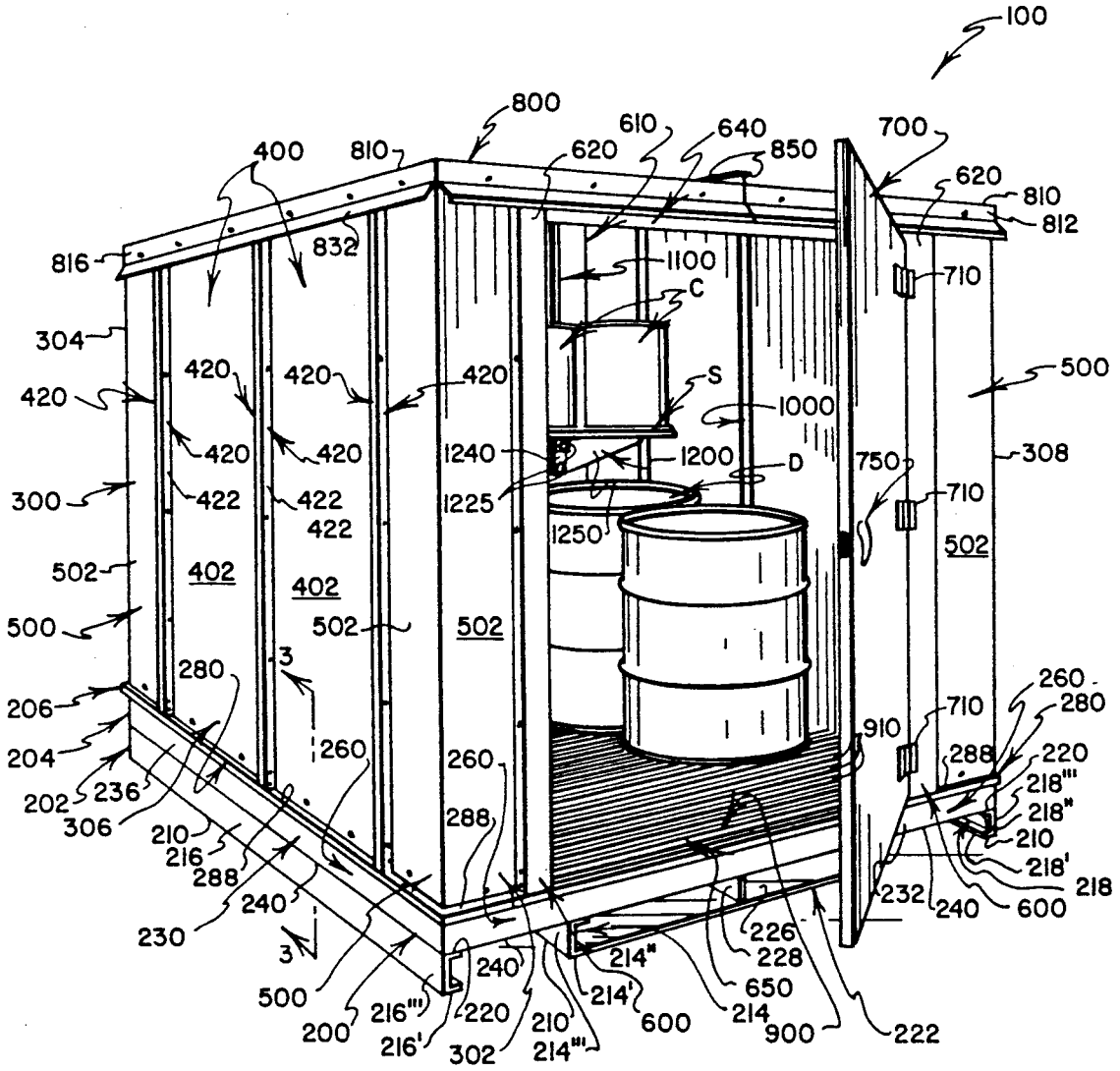
FIG. 1 is a perspective view of one form of a safety enclosure that embodies features of the preferred practice of the present invention, and with the door shown open, with shelf-supported cans and floor-supported drums being pictured within the interior of the enclosure.

Referring to FIG. 1, a "safety enclosure" or "containment building" that represents the best mode for carrying out the preferred practice of the present invention is indicated generally by the numeral 100. In overview, the enclosure 100 has a welded base assembly 200, an upstanding assembly of walls 300 that is supported atop peripheral portions of the base assembly 200, and a roof assembly 800 that is supported atop the wall assembly 300.

Figure 2:
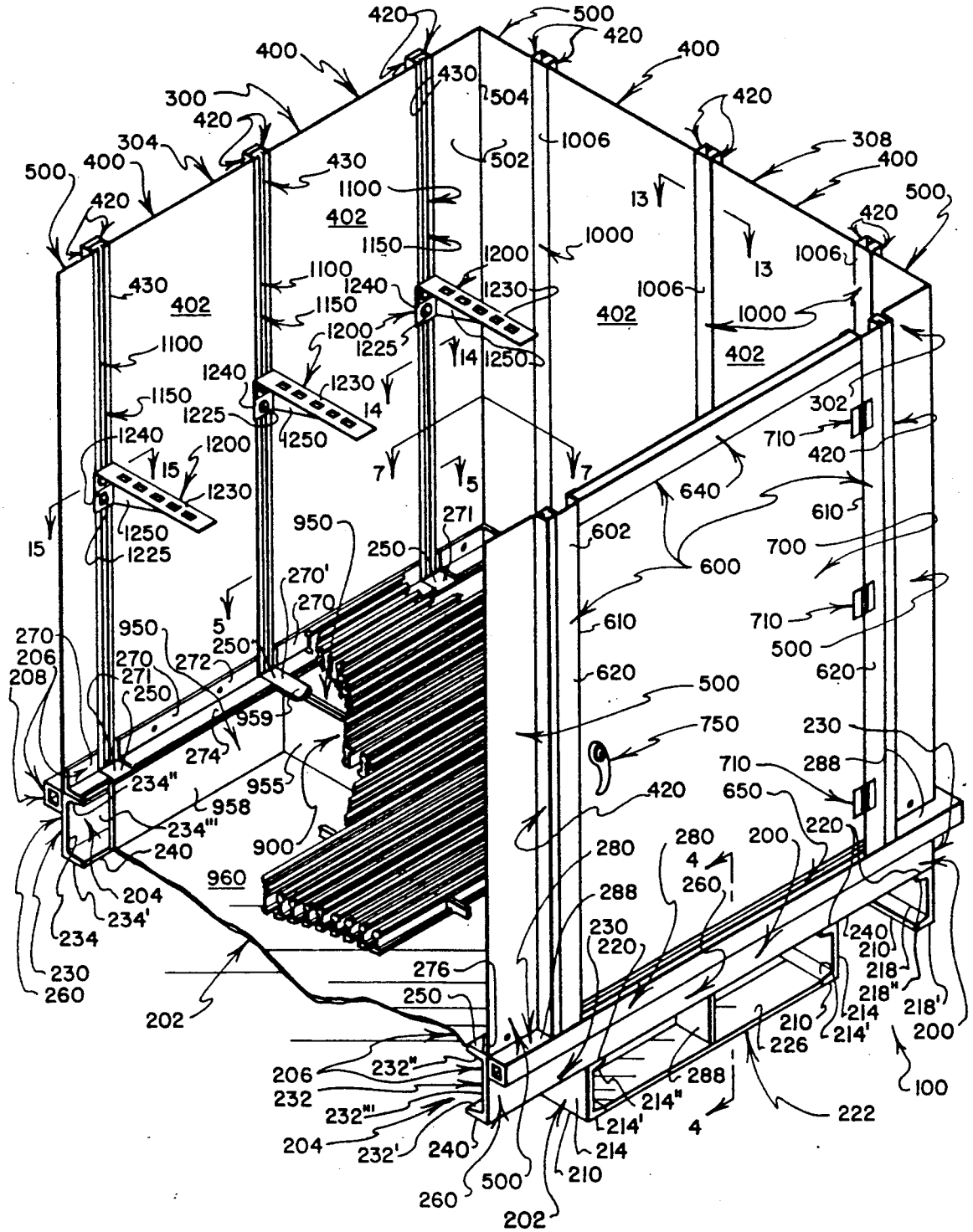
FIG. 2 is a perspective view thereof with the door closed and with portions of the enclosure removed, including portions of the left end region and the roof.

Referring to FIGS. 1 and 2, the wall assembly 300 includes a front wall 302, a back wall 304, and left and right side walls 306, 308. A door frame assembly or "door panel" 600 is incorporated into the front wall 302 and pivotally mounts a door 700 for controlling access through a door opening 310 that is defined by the door panel 600. With the exception of the door panel 600, the wall assembly 300 is formed by an edge-to-edge array of two types of what will be called "standard" panels, namely "standard" flat wall panels 400, and "standard" wall-corner panels 500.

Figure 3:
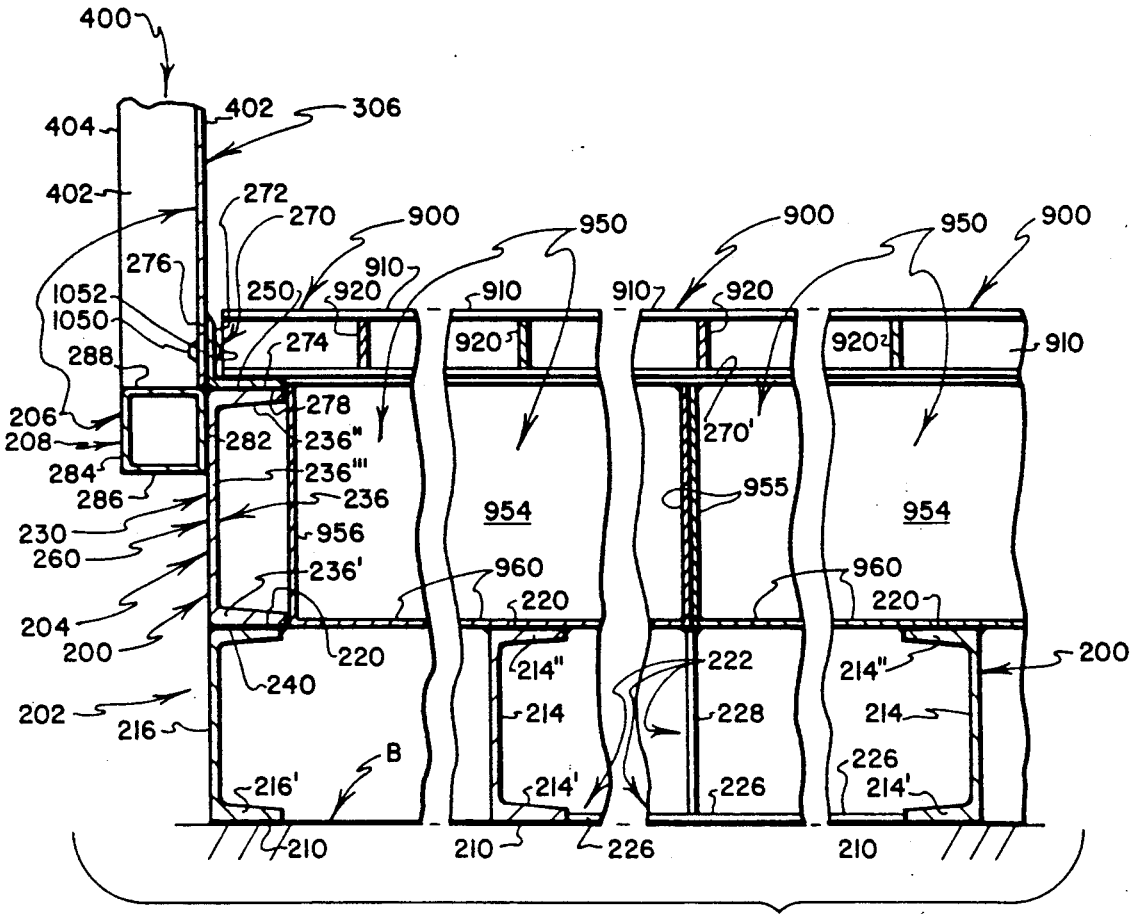
FIG. 3 is a sectional view, on an enlarged scale, as seen from a plane indicated by a line 3—3 in FIG. 1, with this view showing principally features of the welded base assembly, and with portions thereof being foreshortened.

A grate-like floor 900 is shown supported atop the base assembly 200 for providing a container support structure through which liquid can flow into a pair of "secondary containment" vessels. Referring to FIGS. 2 and 3, the secondary containment vessels utilized by the enclosure 100 take the form of a pair of generally rectangular, pan-like "sumps" 950. The floor 900 extends throughout the interior of the enclosure 100, from the front wall 302 to the back wall 304, and from the left end wall 306 to the right end wall 308. The sumps 950 underlie substantially all of the floor 900 with the exception of peripheral, base-engaging portions of the floor 900. The sumps 950 are held at a protectively enclosed but elevated position so that their integrity can be inspected visually from outside the enclosure 100, as by viewing bottom exterior surfaces thereof by looking under elevated front and rear portions of the enclosure 100. Additionally, the sumps 950 can be checked by viewing their interior surfaces as by removing portions or all of the floor 900.

Figure 13:
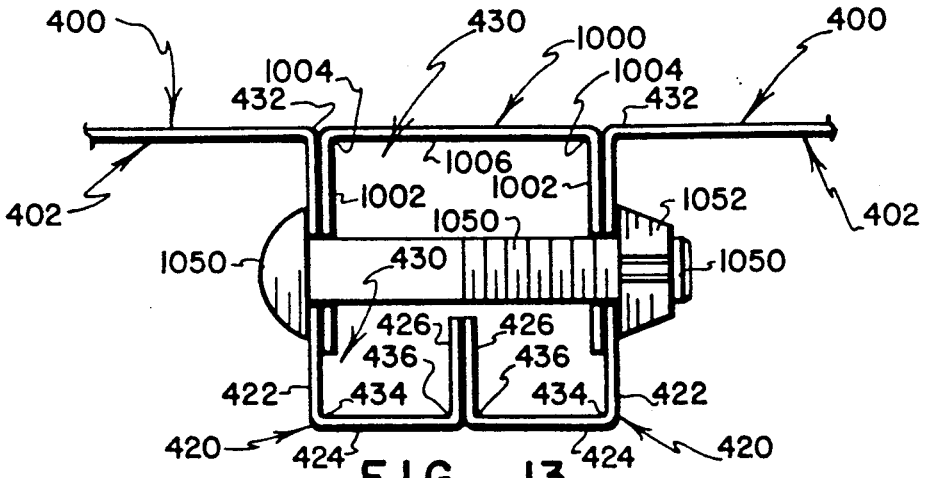
FIG. 13 is a sectional view, on an enlarged scale, as seen from a plane indicated by a line 13—13 in FIG. 2.
Figure 14:
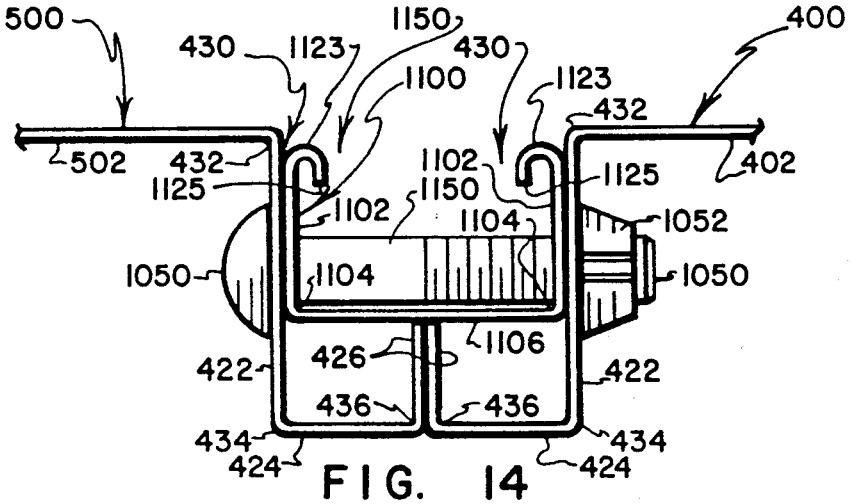
FIG. 14 is a sectional view, on an enlarged scale, as seen from a plane indicated by a line 14—14 in FIG. 2.
Figure 15:
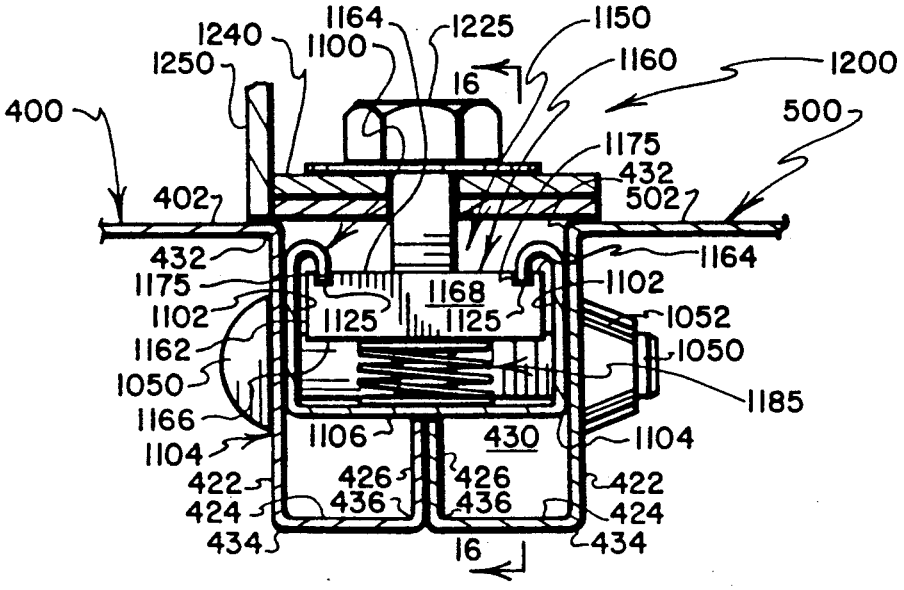
FIG. 15 is a sectional view, on an enlarged scale, as seen from a plane indicated by a line 15—15 in FIG. 2.
Figure 16:
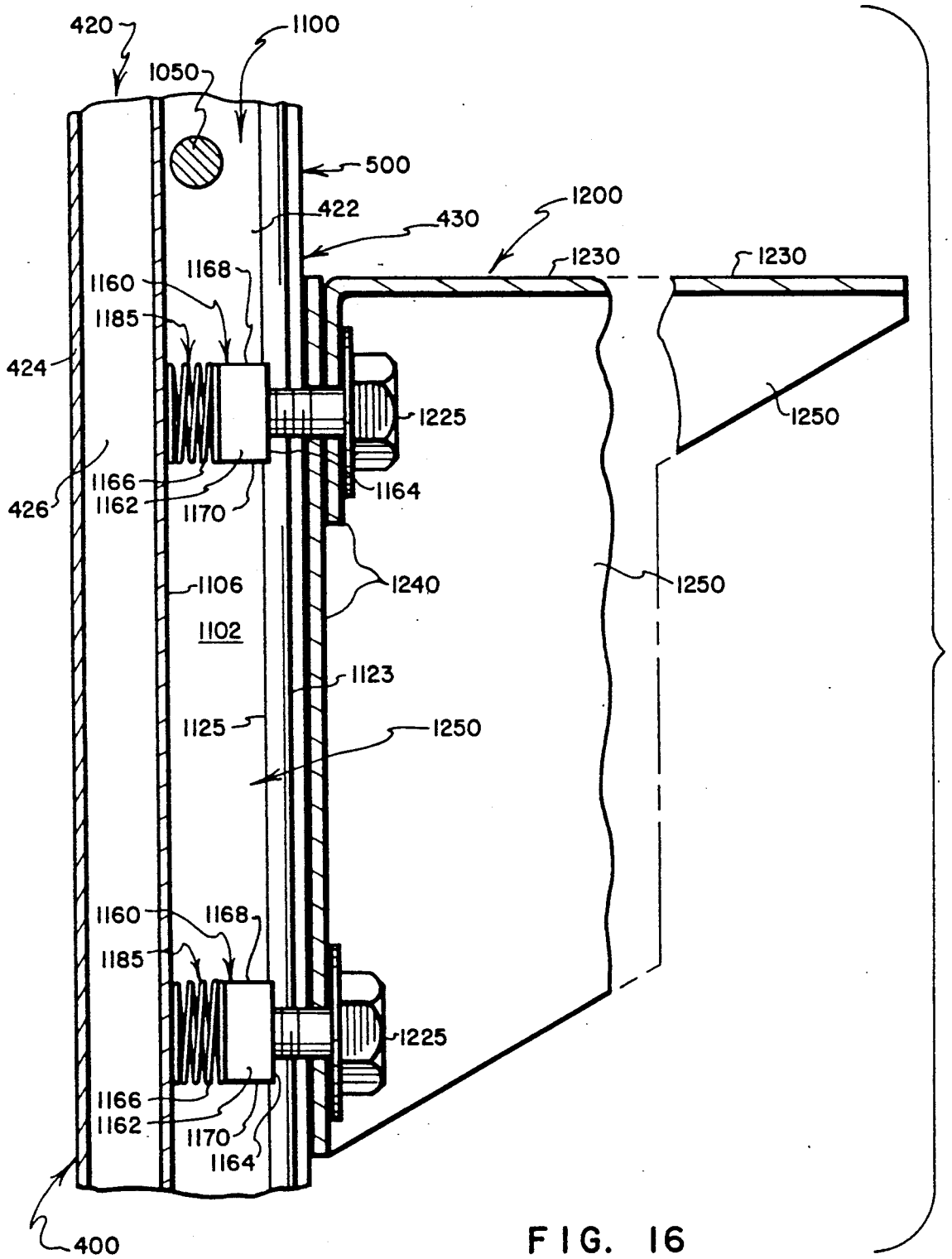
FIG. 16 is a sectional view of portions of a wall-panel-post-connection showing a foreshortened shelf bracket mounted thereon, as seen from a plane indicated by a line 16—16 in FIG. 15.
Figure 17:
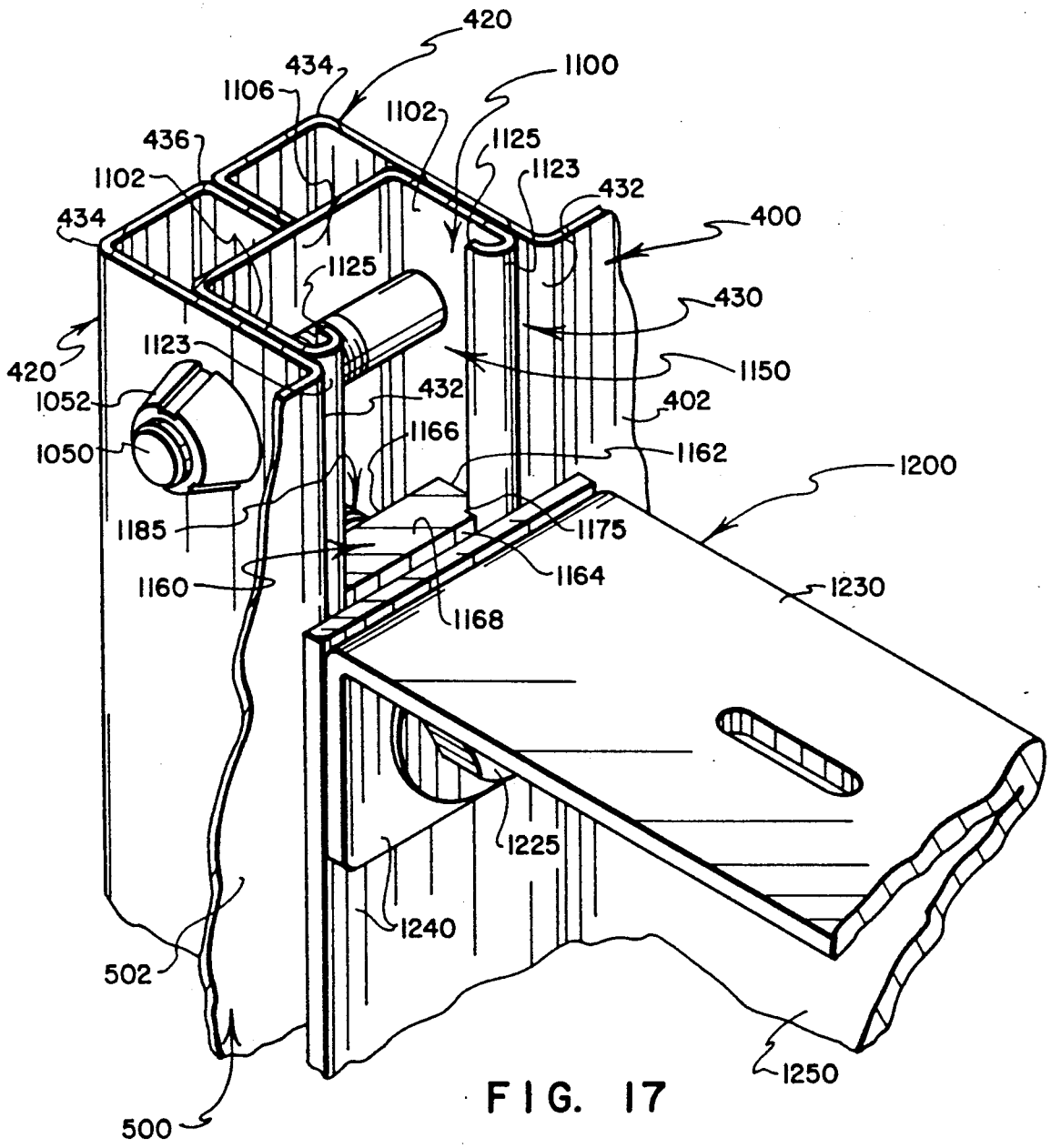
FIG. 17 is a perspective view of portions of a a wall-panel-post-connection and portions of a shelf bracket mounted thereon.
Figure 18:
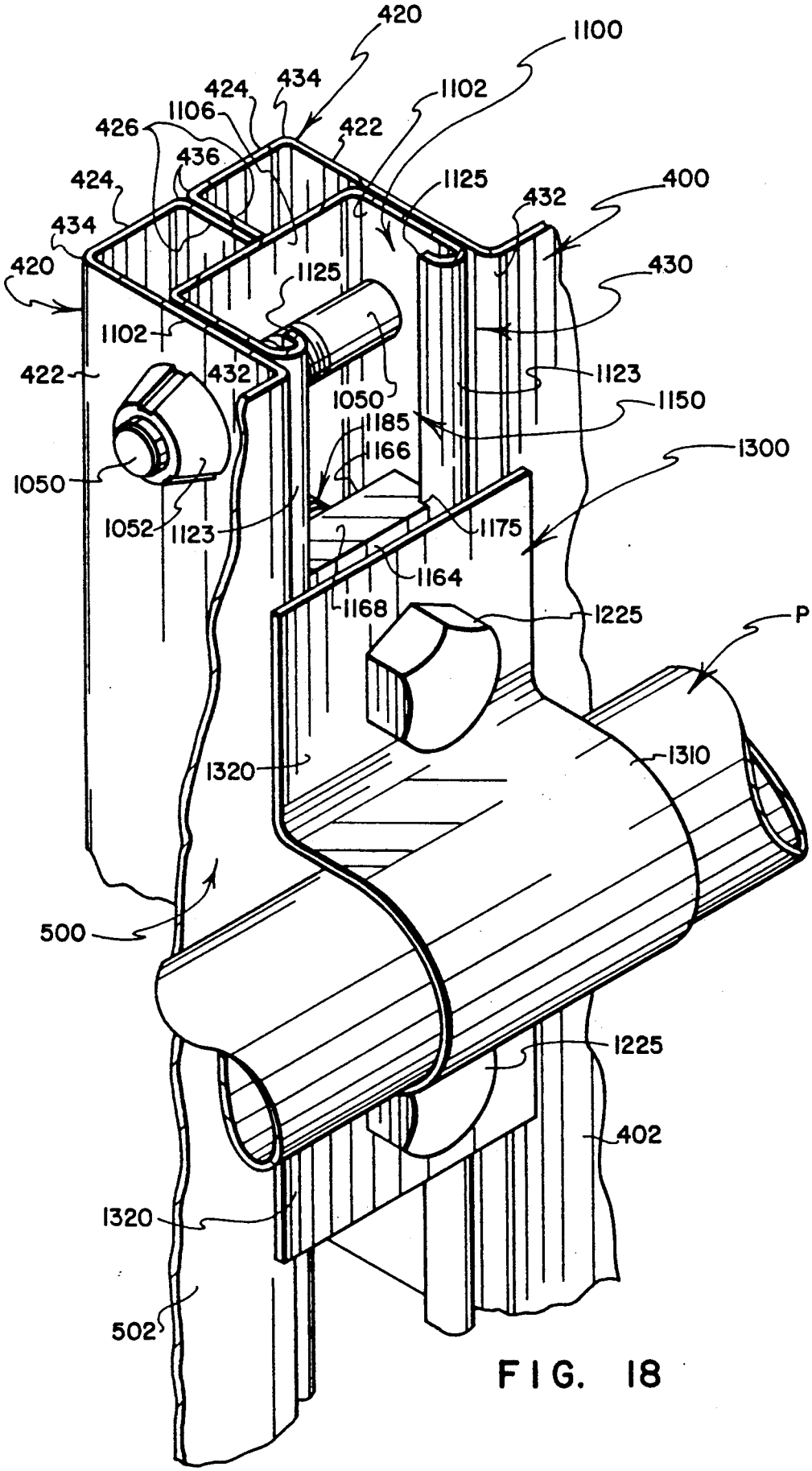
FIG. 18 is a perspective view similar to FIG. 17 but showing a pipe clamp bolted to the wall-panel-post-connection instead of a shelf bracket, with a portion being supported by the pipe clamp.

Continuing this brief overview of basic characteristics of the enclosure 100, reference is made to FIGS. 13 and 14 that depict the use of two types of framing members 1000, 1100 that are carried in inwardly facing recesses defined between abutting edge portions of adjacent pairs of the wall and/or wall-corner panels 400, 500. While the framing member 1000 (shown in FIG. 13) provides a relatively smooth closure of the inwardly facing recess in which it is carried, the framing member 1100 (shown in FIG. 14) provides a specialized mounting track that can be utilized, as is depicted in FIGS. 15–17, to mount a shelf bracket 1200, and as is depicted in FIG. 18 to mount a pipe or conduit support bracket 1300 that is used to support portions of a pipe or conduit "P."

Returning to FIG. 1, as will be apparent from the foregoing summary, the wall and wall-corner panels 400, 500, taken together with the door frame assembly 600, and the door 700 cooperate with the base assembly 200, the roof assembly 800, the floor 900 and the sumps 950 to provide a relatively heavy duty safety enclosure 100 for the housing and storage of containers of "hazardous materials" such as cans of paint, drums of lubricant and the like. While such containers can simply be stored atop the floor 900, in the manner in which a pair of drums "D" are shown positioned within the enclosure 100, a more fitting and organized use of available space provided within the enclosure 100 is achieved by supporting selected containers "C" atop one or more shelves "S" that are carried atop shelf brackets 1200 that are connected to one or more of the framing members 1100.

Turning now to a more detailed description of components and features of the safety enclosure 100, features of the base assembly 200 will be discussed, with reference being made principally to FIGS. 1–4, but with several of the described features being best seen in FIGS. 6 and 8. The base assembly 200 is a welded structure formed from steel components that cooperate to define a generally rectangular structure that can be thought of as including a lower stilt portion 202, a central containment portion 204, and an upper wall support portion 206.

The first and lowermost of the three portions of the base assembly 200, namely the lower stilt portion 202, includes a plurality of channel-type structural steel members that are formed from commercially available channel stock that has a generally C-shaped cross-section of about four inches in height (which members characteristically each have an upstanding web that interconnects with a bottom flange and a top flange). These structural members include a pair of left and right channel members 216, 218 that parallel the left and right end walls 306, 308, respectively; and, supplemental channel members 214 that extend parallel to the left and right channel members 216, 218 and underlie bottom walls 960 of the sumps 950. The channel members 214, 216, 218 extend substantially the full distance between the front and back walls 302, 304; have bottom flanges 214', 216', 218' that define downwardly facing surface portions 210 for engaging a generally horizontal surface "B" (see FIGS. 3 and 4) atop which the safety enclosure 100 is to be installed; and have top flanges 214'', 216'' 218'' that define upwardly facing surface portions 220 that extend in an imaginary "first horizontal plane" (not shown) for engaging and supporting the central containment portion 204 of the base assembly 200 in a manner that will be described shortly.

The lower stilt portion 202 of the base assembly 200 also includes identical front and rear assemblies 222 of components that provide paired connections between channel members 214. In FIGS. 1 and 2, components of a front interconnection assembly 222 are depicted as connecting with front end portions of the channels 214; however, it will be understood that an identical set of components connects with the rear end regions of the channels 214, with portions of the rear interconnection assembly 222 being depicted in FIGS. 3 and 6. Each of the front and rear interconnection assemblies 222 includes a band of steel plate stock 226 that preferably is about four inches wide and that has its opposed end regions welded to the bottom flanges 214' of the channels 214; and, an upstanding piece of steel plate stock 228 that is welded to a central portion of the band 226 and extends upwardly therefrom for connecting with the sumps 950. Referring to FIG. 3, in preferred practice, the sumps 950 have juxtaposed, upstanding walls 955 (see FIG. 3) that abuttingly engage along an imaginary, vertically extending "center plane" (not shown) that is located half way between the left and right end walls 306, 308 of the enclosure 100; and, the upstanding component 228 extends within the center plane and is welded to the upstanding and bottom walls 955, 960 at the junctures thereof. Other features of the sumps 950 will be described shortly.

The second portion of the base assembly 200, namely the central containment portion 204, includes a generally rectangular frame 230 that is formed from four channel-type structural steel members that are formed from commercially available channel stock that has a generally C-shaped cross-section of about five inches in height (which members characteristically each have an upstanding web that interconnects with a bottom flange and a top flange). These structural members include a pair of front and rear members, 232, 234, and a pair of end members 236, 238 that are arranged end-to-end to define a rectangle that has one end of each of the end members 236, 238 welded to a separate one of the opposed ends of the front member 232, and that has the other end of each of the end members 236, 238 welded to a separate one of the opposed ends of the rear member 234.

The structural members 232, 234, 236, 238 have bottom flanges 232', 234', 236' 238' that define downwardly facing surface portions 240 that extend in the "first horizontal plane" where, at points of engagement with the top flanges 214'', 216'', 218'' welds are formed to rigidly connect the rectangular frame 230 to the underlying channel members 214, 216, 218; have top flanges 232'', 234'', 236'', 238'' that define upwardly facing surface portions 250 that extend in an imaginary "second horizontal plane" (not shown); and have upstanding webs 232''', 234''', 236''', 238''' that define an outer perimeter surface 260 that extends substantially continuously about and defines the outer perimeter of the generally rectangular frame 230.

The central containment portion 204 also includes the "secondary containment" vessels or "sumps" 950. While safety enclosures of sizes that are larger or smaller that of the enclosure 100 may advantageously be provided with a greater or lesser number of sumps than the two sumps 950 that are utilized by the enclosure 100, it will be understood that, in preferred form, such sumps take the form of generally rectangular pans that each are formed from a single sheet of steel having a thickness of about 10 gage sheet stock, with the bottom wall 960 thereof being seamless, with the upstanding side walls being formed by folding the sheet stock to provide unbroken, slightly-rounded bottom-to-wall junctures, and with corner intersections of the upstanding walls being carefully welded to provide leak-resistant sumps 950 that are about five inches deep.

In safety enclosures that embody the preferred practice of the present invention, the sump or sumps that are employed therein should substantially fill the area that is defined by the rectangular frame (such as the frame 230) that defines the perimeter of the central containment portion 204. In the example of the enclosure 100, what this means is that the sumps 950 are configured and arranged to effectively define an upwardly opening catch basin that extends in a front-to-rear direction substantially the entire distance between the front and rear members 232, 234, and in an end-to-end direction substantially the entire distance between the end members 236, 238.

Figure 7:
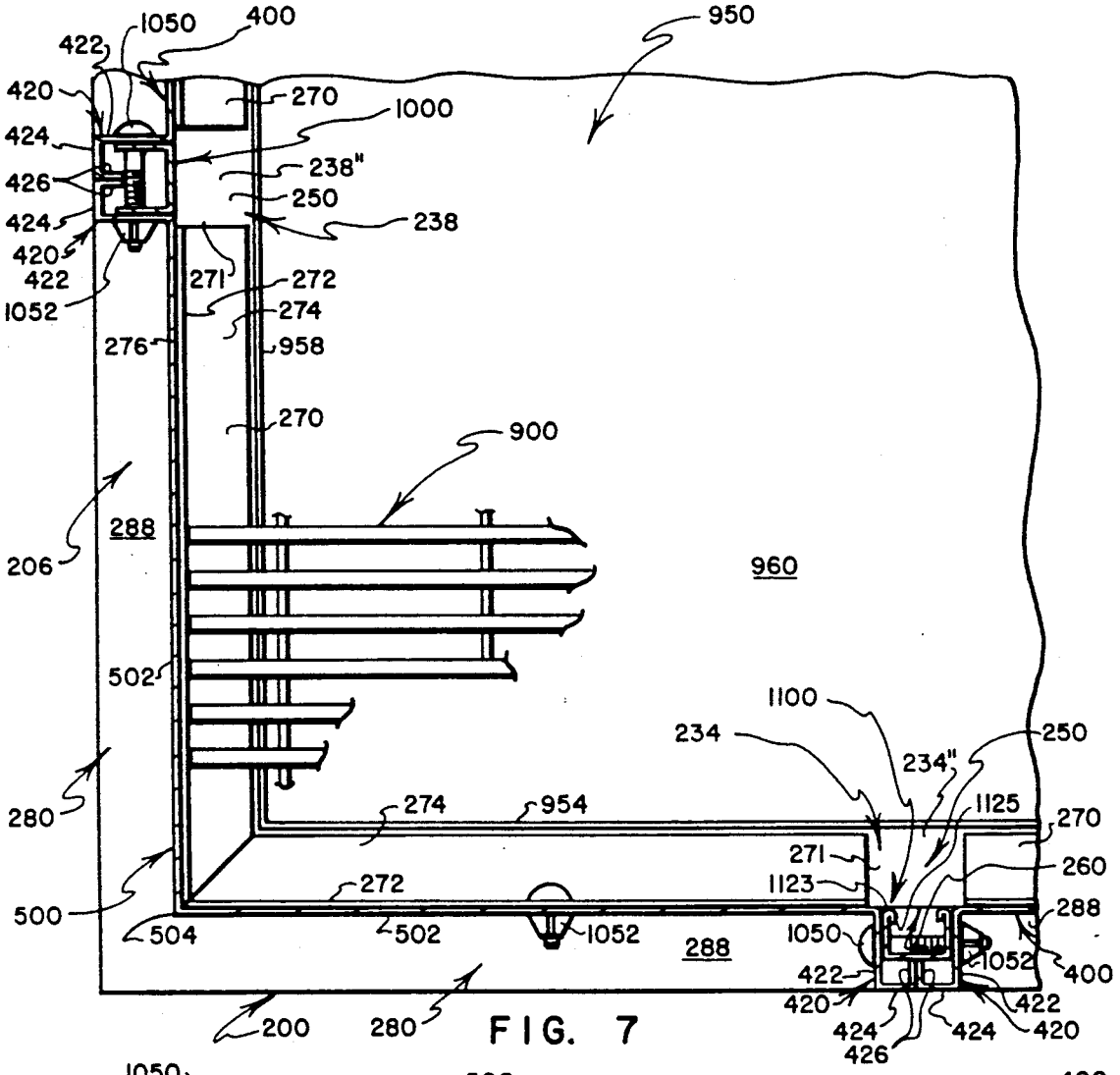
FIG. 7 is a sectional view, on an enlarged scale, as seen from a plane indicated by a line 7—7 in FIG. 2, with this view showing principally features of a "standard" L-shaped corner-wall panel and its connection to the base assembly.

Stated with more particularity, the sumps 950 each have front walls 952 that extend in close proximity to the front channel member 232 (see FIG. 4), and rear walls 954 that extend in close proximity to the rear channel member 234 (see FIGS. 2, 5 and 7); the left one of the sumps 950 has a left wall 956 that extends in close proximity to the left channel member 236; and, the right one of the sumps 950 has a right wall 958 that extends in close proximity to the right channel member 238 (see FIG. 7). There are a number of welds that are employed in fabricating the welded base assembly 200 that assist in properly mounting the sumps 950; and, in the next few paragraphs, they will be described.

Welds are formed between the upper end regions of the sump walls 952, 954, 956, 958 and juxtaposed top flange portions 232", 234", 236", 238" of the channel members 232, 234, 236, 238, respectively, to provide leak-resistant connections between the channel members 232, 234, 236, 238 and the sump walls 952, 954, 956, 958. Actually, in preferred practice, these same welds also serve to provide a leak-free connection with inner edges of angle iron members 270 that are welded atop the top flanges 232", 234", 236", 238" to assure that, if any significant quantity of liquid is splashed onto inner surface portions of one or more of the angle iron members 270, such liquid is ducted into the sumps 950 as by flowing under the influence of gravity across the weld bead that extends from the splashed angle iron(s) 270 into adjacent sump(s) 950. A discussion of the character and positioning of the angle iron members 270 will follow shortly.

Welds are formed between the lower end regions of the sump walls 952, 954, 956, 958 and juxtaposed bottom flange portions 232', 234', 236', 238' of the channel members 232, 234, 236, 238, respectively; however, these welds tend to be intermittent in nature and principally serve to connect lower regions of the sumps 950 to the channel members 232, 234, 236, 238. Welds are formed between the underside of the bottom walls 960 and the top flanges 214" of the channel members 214. Likewise, juxtaposed upper end regions of the central walls 955 of the sumps 950 are securely welded together to prevent leakage therebetween; and, a strip 271 of metal is intermittently welded to the already-welded upper end regions of the central walls 955 to provide a centrally located support for the removable floor structure 900.

In preferred practice, the combined liquid containing capacity of the sumps that are provided for a particular safety enclosure will have a "holding capacity" of about twenty five percent of the total capacity of the maximum volume of such containers as are permitted to be stored within the enclosure. By this arrangement (and assuming that the sumps are inspected at frequent intervals of time to assure that, if anything has been collected therein, it is safely removed and disposed of, and to assure that sources of spillage and leakage are found and promptly corrected), the safety enclosure normally can be expected to serve well as a means for preventing accidental spillage and unanticipated leakage from escaping and causing environmental damage.

The third portion of the base assembly 200, namely the upper wall support portion 206, includes a first type of wall support that takes the form of lengths of angle-iron stock 270, and a second type of wall support that takes the form of lengths of square tubing stock 280. The angle iron supports 270 are of conventional L-shaped cross-section featuring vertical legs 272 and horizontal legs 274 (see FIG. 5) that define a vertical, outwardly facing surface 276 and a horizontal downwardly facing surface 278, respectively (see FIGS. 3 and 4), with each of the leg surfaces 276, 278 being about one and a half inches in width. The square tubular supports are formed from lengths of commercially available steel tubing that measures about one and a half inches along each of its four sides 282, 284, 286, 288 (see FIGS. 3 and 4).

The angle iron supports 270 are welded atop the rectangular frame 230. More specifically, the angle iron supports 270 are welded in place with their downwardly-facing surfaces 278 in engagement with the upwardly facing support surface 250 that is defined by top flanges 232", 234", 236", 238", and with their vertically extending surfaces 276 facing outwardly and extending in the same planes as the perimetrically extending surface 260 of the frame structure 230. The angle iron supports 270 extend in a discontinuous manner atop the upwardly facing support surface 250 such that spaces 271 are defined between adjacent ones of the angle iron supports 270 at locations where joints will be formed between the wall and/or wall-corner panels 400, 500. At locations along the perimeter of the rectangular frame 300 where the angle iron supports 270 are welded in place, the vertically extending surfaces 276 effectively provide upwardly extending extensions of the outer perimeter surface 260 of the rectangular frame 230.

The square tubular members 280 welded to the perimetrically extending outer surface 260 of the rectangular frame 230. More specifically, the tubular members 280 are welded in place with their inwardly facing surfaces 282 engaging the perimetrically extending surface 260 of the rectangular frame member 230, and with their upwardly facing surfaces 288 extending in the same plane as the upwardly facing support surface 250 that is defined by the rectangular frame assembly 230. The square tubular members 280 extend in a continuous fashion about the entire perimeter of the rectangular frame 230 so as to provide an uninterrupted, outwardly projecting extension of the upwardly facing mounting surface 250, with the upwardly facing surfaces 288 extending in an uninterrupted band about the perimeter of the rectangular frame 230.

Figure 5:
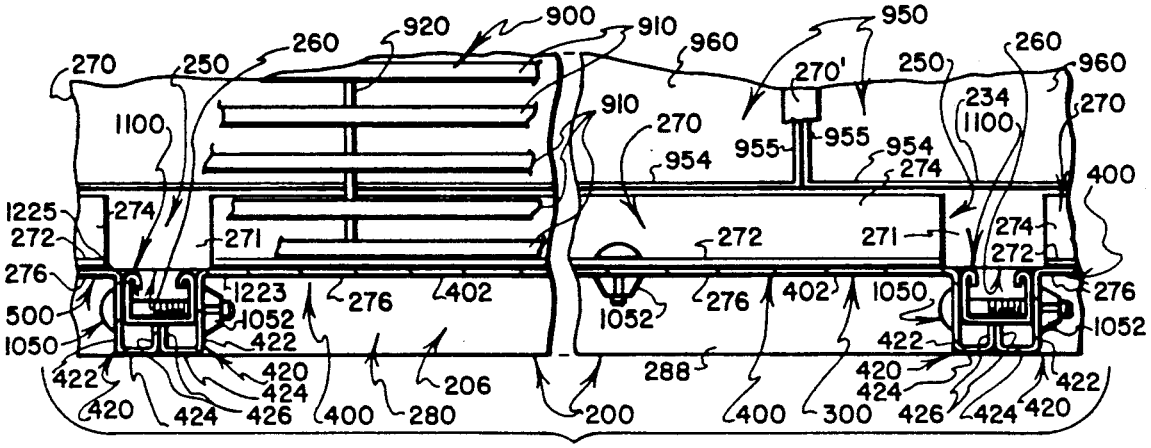
FIG. 5 is a sectional view, on an enlarged scale, as seen from a plane indicated by a line 5—5 in FIG. 2, with this view showing principally features of a "standard" flat wall panel and its connection to the base assembly, with portions thereof being foreshortened.
Figure 6:
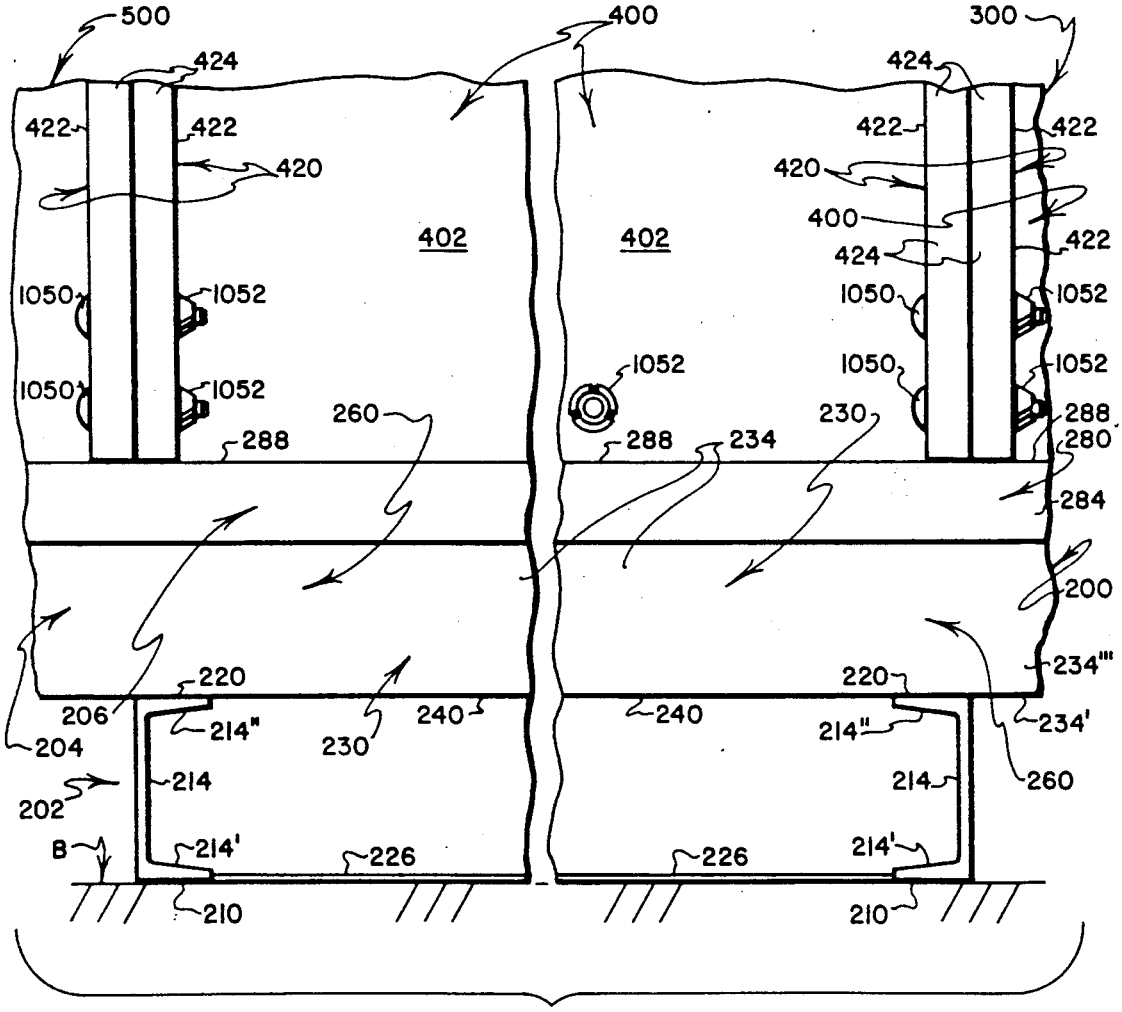
FIG. 6 is a side elevational view of the enclosure portions that are shown in FIG. 5 as seen from the exterior, with portions thereof being foreshortened.

Referring to FIGS. 2, 5 and 6, the flat wall panels 400 that form selected portions of the wall assembly 300 are each formed from a single piece of material, preferably sheet steel having a thickness of about 12 gage. Each wall panel 400 has a relatively wide, flat central region 402 that is bounded on opposite sides by vertically extending edge formations 420 that are identically configured except that each is the mirror image of the other. Each wall panel 400 has a bottom region 404, a top region 406, an inside surface 408 and an outside surface 410.

Referring to FIG. 13, portions of a pair of adjacent wall panels 400 are illustrated, together with one of two preferred ways in which a secure, enclosure strengthening connection is formed between abutting edge formations 420 of the illustrated panel portions. Each of the edge formations 420 is of substantially J-shape when viewed in cross-section, and includes a relatively long first leg 422, and a pair of relatively shorter second and third legs 424, 426. Each of the first, second and third legs 422, 424, 426 is formed as an integral part of its associated wall panel 400. Each such leg is defined by a substantially flat reach of vertically extending sheet metal, that, when viewed in cross-section (e.g., as in FIG. 13), has the appearance of an elongate element that has parallel sides that extend between a pair of opposite end regions.

Each of the relatively long first legs 422 is connected at its inner end region to the adjacent central portion 402 of its associated panel 400 by a bend 432 that is of generally right-angle, small-radius character that causes the first leg to extend outwardly from the plane of the adjacent central portion 402. Each of the relatively shorter second legs 424 is connected at one end region thereof to the outer end region of its associated long first leg 422 by a bend 434 that is of generally right-angle, small-radius character and causes the second leg to extend in an outer plane (not shown) that substantially parallels the plane of the central portions of its associated panel 400 but at a location spaced outwardly therefrom. Each of the third legs 426 is connected at its outer end region to the other end region of its associated second leg 424 by a substantially right-angle, small-radius character that causes the third leg to extend inwardly from the aforedescribed outer plane within which the associated second leg extends, whereby the third legs 426 are caused to parallel their associated first legs 422 but at a distance spaced therefrom. Each of the third legs 426 terminates in an end formation that is located between the plane of its associated central portions, and the aforedescribed outer plane.

Abutting engagement along substantially the full lengths of the pair of J-shaped edge formations 420 of the adjacently positioned panels 400 is provided by substantially continuous engagement between the two juxtaposed third legs 426. Because the central portions 402 of the adjacent panels 400 extend in substantially the same plane, and because the J-shaped edge formations 420 project outwardly and engage each other in such a way that causes the central portions 402 to be spaced apart, what the abuttingly engaged J-shaped formations 420 cooperate to define inwardly-facing recesses 430 that preferably are utilized to receive one or the other of the elongate framing members 1000, 1100, each of which provides what can be characterized as a generally U-shaped "insert."

Referring to FIG. 13, the framing member 1000 has opposed side portions 1002 that extend in spaced, parallel relationship and have inner portions thereof integrally connected, as by right-angle, small-radius bends 1004, to a central portion 1006 that extends (when the framing member 1000 is positioned in the recess 430 as is illustrated in FIG. 13) in substantially the same plane as the central portions 402 of the wall panels 400. The framing member 1000 serves to give the juncture of wall panel portions that is illustrated in FIG. 13 a relatively smooth-structured character. In a more important role, however, the framing member 1000 cooperates with the J-shaped edge formations 420 to form a columnar-like post that extends the entire distance from the base assembly 200 to the roof assembly 800, with the lower end thereof resting atop the upwardly facing surface 288 (see FIG. 3), and with the upper end thereof engaged by a cap member 802 that, in essence, forms a part of the roof assembly 800, which will be described shortly.

Referring still to FIG. 13, a threaded fastener in the form of a conventional carriage bolt 1050 is shown extending through aligned holes that are formed through the first legs 422 and the opposed side portions 1002. A lock nut 1052 is threaded onto the bolt 1050 and tightened in place to securely clamp together and rigidly connect the aforedescribed components that are shown in FIG. 13. Actually, a plurality of the bolts 1050 are used at vertically spaced locations along the length of the edge formations 420. Since the lock nuts 1052 that are threaded onto the bolts 1050 are located outside the enclosure 100, the precaution is taken of utilizing lock nuts 1052 that require the use of a special tool to engage them so that they can be loosened or tightened. The preferred form of locknut 1052 that is used is sold under the trademark TAMPRUF by Allegheny Bolt & Screw Corporation of Valley Stream, N.Y. 11580. The same types of locknuts as the locknut 1052 are used in a number of places in assembling the enclosure 100 (as will be readily apparent from a review of what is depicted in FIGS. 5–8 wherein several of these nuts are shown in use). However, other commercially available forms of tamper-resistant security fasteners can be substituted if desired.

Figure 19:
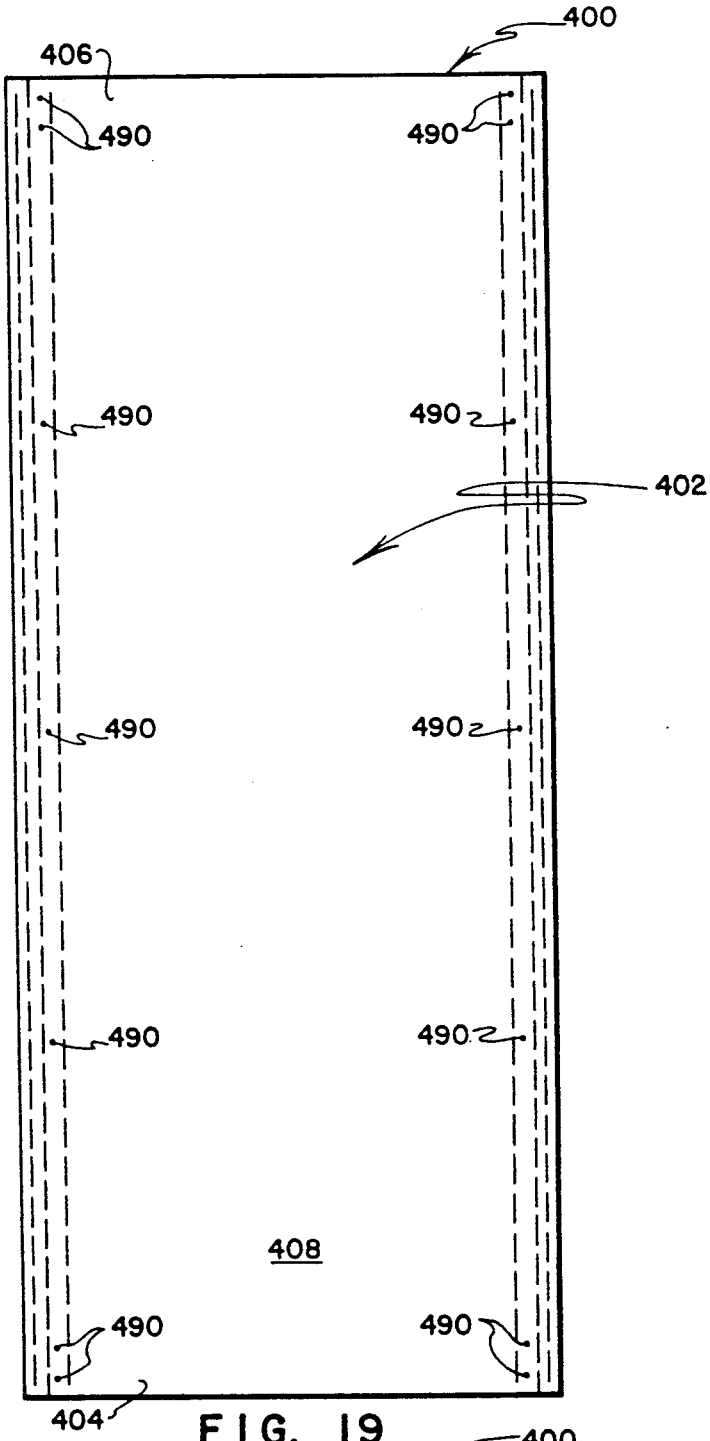
FIG. 19 is a side elevational view of the "layout" of a flat wall panel before edge portions thereof are folded to form a pair of J-shaped edge regions of the type that embody the preferred practice of the present invention.
Figure 20:
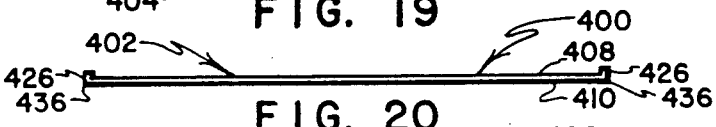
FIG. 20 is an end elevational view of the flat wall panel of FIG. 19 but with a first "fold" having been made along opposed edges thereof to illustrate a first step in the fabrication of the J-shaped edge regions.
Figure 21:
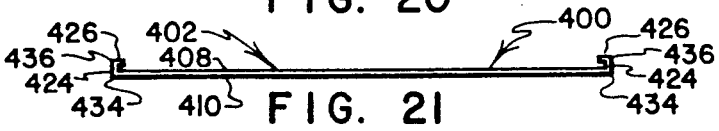
FIG. 21 is an end elevational view of the wall panel of FIG. 20 with a second "fold" having been made during the fabrication of the J-shaped edge regions.
Figure 22:
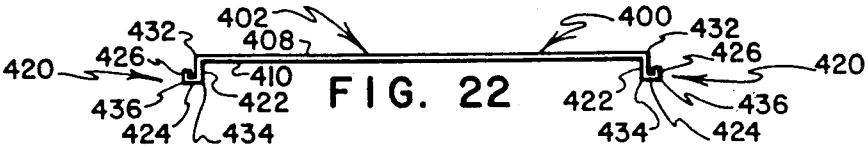
FIG. 22 is an end elevational view of the wall panel of FIG. 21 with a final "fold" having been made in the fabrication of the J-shaped edge regions.

Diverting briefly to FIGS. 19–22 before moving ahead with the description of the alternate framing member 1100 that is employed in the preferred practice of the present invention, the method by which one of the flat wall panels 400 is formed is illustrated. Beginning with FIG. 19, a "layout" is made on a cut-to-size piece of sheet metal (typically 12 gage steel that either is bought "pre-finished" or is factory finished after its edge formations 420 are formed. Holes 490 are drilled or punched at various desired locations for receiving threaded fasteners such as the aforementioned carriage bolt 1050; and, when all is in readiness, opposite edge regions of the flat sheet of FIG. 19 are "folded" to provide right angle bends 436 that connect the second and third legs 424, 426 of the J-shaped edge formations 420. Next, additional folds are made to provide the right angle bends 434 that connect the first and second legs 422, 424. Lastly, bends 432 are made to connect the first legs 422 with the central portions 402.

Figure 8:
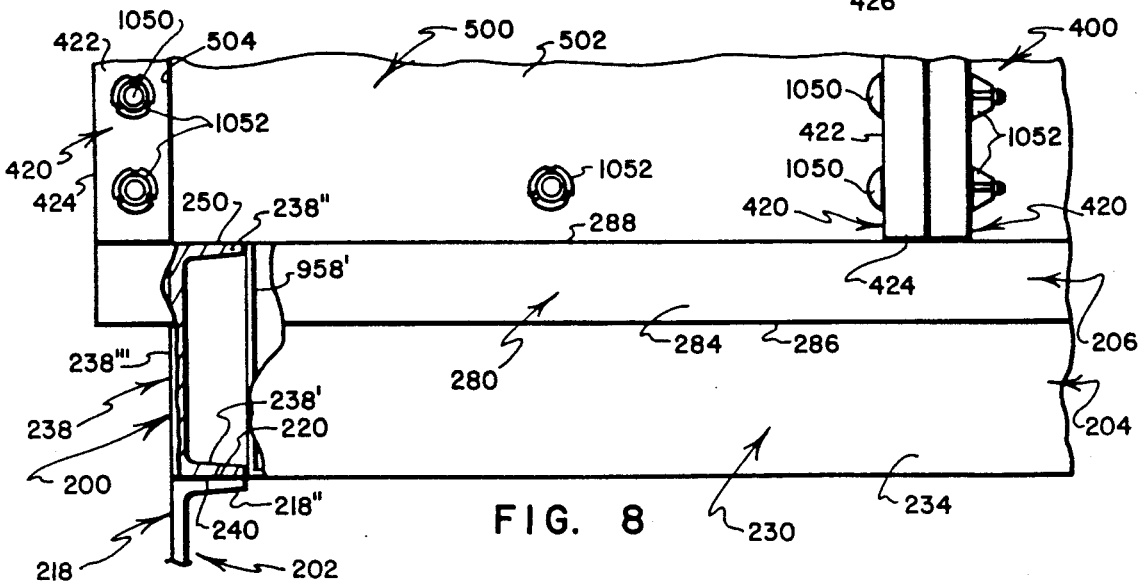
FIG. 8 is a side elevational view of the enclosure portions that are shown in FIG. 7 as seen from the exterior, with portions thereof broken away.

Referring to FIGS. 7 and 8, the wall-corner panels 500 are identical in all essential respects to the flat wall panels 400—except that, the wall-corner panels incorporate one additional, centrally located right-angle, short-radius bend 504 that divides center portions of the panels 500 into a pair of substantially equal-sized center portions 502. Inasmuch as the wall-corner panels 500 have edge formations 420 that are identical to the edge formations that are described above, there is no difference in the character of a connection that is formed between a pair of wall panels 400, a pair of wall-corner panels 500, or one wall panel 400 and one wall-corner panel 500—except that, if the framing member 1100 is substituted for the framing member 1000, a columnar post-like connection that has features that differ from connections that are formed using the framing member 1000 is provided.

Referring to FIG. 14, the framing member 1100 has opposed side portions 1102 that extend in spaced, parallel relationship and have inner portions thereof integrally connected, as by right-angle, small-radius bends 1104, to a central portion 1106 that extends (when the framing member 1100 is positioned in the recess 430 as is illustrated in FIG. 14) across the recess 430 at a location that is spaced rearwardly from the inwardly-facing opening of the recess 430. In preferred practice, the central portion 1106 extends across the recess 430 at a location adjacent the inner end regions of the third legs 426 so as to cooperate with the opposed side portions 1102 to provide a strongly reinforced structure that defines a vertically extending recess that opens into the interior of the enclosure 100.

In effectively the same manner as has been described in conjunction with the framing member 1000, aligned holes are formed through the opposed side portions 1102 of the framing member 1100, and through the first legs 422 of the J-shaped edge formations 420 to receive threaded fasteners such as the aforedescribed carriage bolts 1150. In effectively the same manner as has been described in conjunction with the framing member 1000, nuts 1152 are tightened in place on the carriage bolts 1050 to clamp the J-shaped edge formations 420 together so as to maintain good top-to-bottom engagement of the third legs 426 of the J-shaped formations 420, and to assure that the first legs 422 clamp opposed sides 1102 of the framing member 1100. And, in effectively the same manner as has been described in conjunction with the framing member 1000, the framing member 1100 extends in an uninterrupted manner for the full distance between the base and roof assemblies 200, 800 so as to cooperate with the J-shaped edge formations 420 in providing a rigid, columnar, post-like support that not only strengthens the wall assembly 300 but also assists in supporting the roof assembly 800 atop the base assembly 200. Additionally, the framing member 1000 serves another function, which will now be discussed.

Referring to FIG. 14, the opposed side portions 1102 have inner end regions 1123 that are reversely turned so as to define substantially identical arcs of generally semi-circular shape that narrow frontal portions of the inwardly-facing recess that is defined between the opposed side portions 1102. The reversely turned formations 1123 have end surfaces 1125 that face toward the central portion 1106 and that extend in a plane that substantially parallels the plane of the central portion 1106. By this arrangement, what will be referred to as an inwardly-opening, vertically-extending recess or "mounting track" 1150 is defined that has a front opening that is reduced in width to the distance between the rounded end formations 1123, but which functions quite nicely to receive nut-like fasteners 1160 such as are depicted in FIGS. 15–18.

The nut-like fasteners 1160 are of generally rectangular configuration, have opposed ends 1162 that are connected by front and back surfaces 1164, 1166 (see FIG. 15) and by top and bottom surfaces 1168, 1170 (see FIG. 16). The size and generally rectangular shape of the nut-like fasteners 1160 is selected so as to enable the fasteners 1160 to be inserted between the curved end formations 1123 and into the widest portion of the mounting track 1150 so as to assume the positions that are depicted in FIGS. 15–18.

A pair of notches 1175 are formed in the front surface 1164 of each of the fasteners 1160 for engaging the end surfaces 1125. The engagement of the notches 1175 with the end surfaces 1125 assists in maintaining the proper orientation of the nut-like fasteners 1160 during vertical movement in the mounting track 1150, and also is useful in assisting to maintain proper orientation when threaded fasteners (such as the bolts 1225 that are shown in FIGS. 15–18) are being threaded into central threaded openings of the nut-like fasteners 1160. Also helpful in positioning the fasteners 1160 are compression coil springs 1185 that are interposed between fastener back surfaces 1166 and the central portions 1106 of the framing members 1100.

In preferred practice, the framing members 1100 are commercially purchased items that are of the type sold by Wesanco, Inc. of Warren, Ohio 44483, under the product designation W-800. However, as those who are skilled in the art will readily understand, other types of framing members can be installed in the recesses 430 that are defined by the "double-J" arrangement of the edge formations 420 and can be bolted or otherwise secured in place to bridge the joint between the edge formations 420, to enhance the strength of the wall assembly 300, and to extend the full distance from the base assembly 200 to the roof assembly 800 in a columnar, post-like manner.

In preferred practice, the nut-like fasteners 1160 and their associated springs 1185 are commercially purchased items that also are sold by Wesanco, Inc., under the product designation W-2-6. However, as those who are skilled in the art will readily understand, other types of fasteners can be employed with the framing members 1100 or with such other types of framing members as one may select for use in the recesses 430, for providing a simple means of securely mounting brackets and the like at positions along the recesses 430.

Referring to FIGS. 15–17, portions of a shelf bracket are shown connected by the aforementioned bolts 1225 to a pair of the nut-like fasteners 1160 that are carried in the mounting channels 1150 of the framing members 1100. While any of a wide variety of commercially available shelf brackets can be used for supporting one or more shelves (such as the shelf "S" that is depicted in FIG. 1), to project into the interior of the enclosure 100 at desired heights, a variety of sizes of shelf brackets of the type that is depicted in FIGS. 1, 15 and 17 is sold by Wesanco, Inc. under the designation Series 56 Shelf Brackets. Included in the series are left and right twenty inch brackets that are sold under the product designations W-5615 and W-5616; and, left and right twenty-four inch brackets that are sold under the product designations W-5619 and W-5620 that have been found to serve well when used with the aforedescribed type of Wesanco framing member and fastener assembly.

Because the provision of a special type of shelf bracket for use with the enclosure 100 does not form a part of the present invention, it will simply be observed that the aforedesignated type of shelf bracket 1200 (portions of which are depicted in FIGS. 1 and 15–17) represents the preferred type of bracket for use with enclosures that embody the present invention; and that each such shelf bracket is formed from a single piece of sheet steel (typically about 12 gage in thickness) that, like other components of the enclosure 100 is protectively finished with a suitable chemical resistant coating, and that defines a horizontally extending top leg 1230, a vertically extending rear leg 1240 that carries suitable holes for receiving the mounting bolts 1225, and a vertically extending web 1250 that rigidly interconnects the legs 1230, 1240.

Referring to FIG. 18, a pipe clamp 1300 is shown connected to one of the framing members 1100 in substantially the same manner as the shelf bracket 1200, namely by bolts 1225 that extend through spaced holes that are formed in the bracket 1200. The pipe clamp 1300 is of any of a wide variety of types that can be purchased commercially and that have a U-shaped central region 1310 bordered by a pair of flat end regions 1320. A section of pipe or electrical conduit "P" is shown supported by the pipe clamp 1300.

Figure 28:
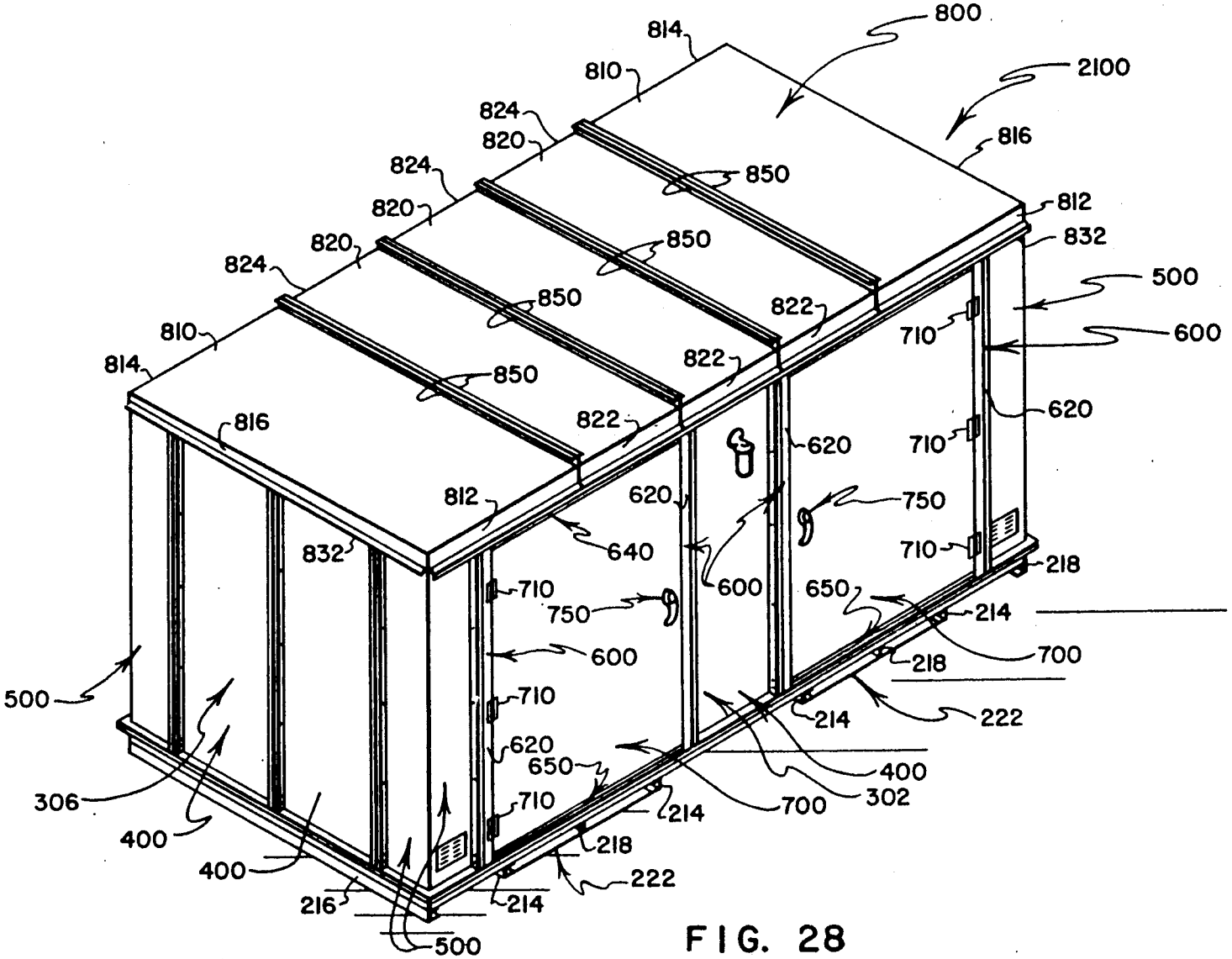

Referring to FIGS. 1 and 2, the door frame assembly or "door panel" 600 defines a door opening 610, access through which is selectively controlled by the door 700 which can be moved from an open position (as shown in FIG. 1) to a closed position (as shown in FIG. 2). While the door 700 is connected along its right side by hinges 710 to the door panel 600, reference is made to FIG. 28 wherein another safety enclosure embodiment 2100 is shown that incorporates both left and right hinged doors 700. Both left and right hinged doors 700 can be mounted in door openings 610 that are defined by the door panels 600.

Referring to FIGS. 9–12, the door panel 600 is formed as an assembly of components. While the wall and wall-corner panels 400, 500 are each formed from a single piece of sheet steel stock, a number of separately formed components are utilized in forming the door panel 600. Like the wall panels and wall-corner panels 400, 500, the components that form the door panel 600 preferably are formed from sheet steel (typically of 12 gage thickness) and are pre-finished with chemical resistant coating prior to being assembled.

The components of the door panel 600 include a pair of left and right upright members 620 that are identically configured, except that each is the mirror image of the other, a header 640, and a footer 650. The header and footer 640, 650 are interposed between portions of the left and right upright members 620 and cooperate therewith to define the door opening 610.

Figure 10:
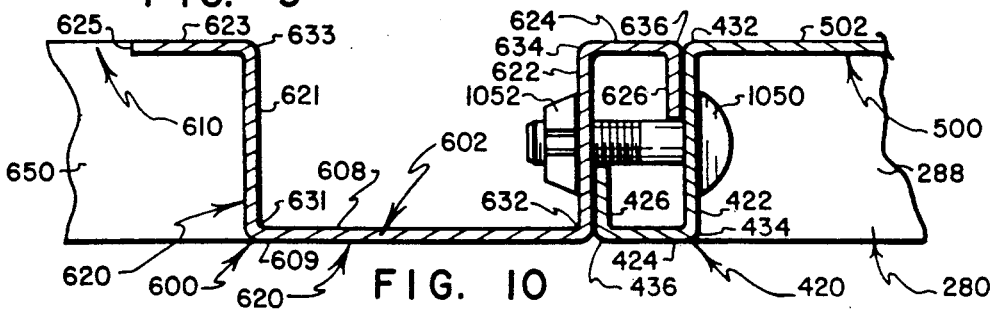
FIG. 10 is a sectional view, on an enlarged scale, as seen from a plane indicated by a line 10—10 in FIG. 9, with this view showing principally features of a the character of the connection that is made between the door panel and edge portions of an adjacent wall-corner panel.

Referring principally to FIG. 10, one of the upright members 620 is shown in cross-section together with one of the aforedescribed J-shaped edge formations 420 of a wall or wall-corner panel 400, 500 to which the upright member 620 is connected as by utilizing carriage bolts 1050 and nuts 1052. Each of the upright members 620 has a substantially flat central portion 602 that has an outer surface 609 and an inner surface 608.

A pair of right angle bends 631, 632 connect the central portion 602 to a pair of inwardly extending legs 621, 622 that are of substantially the same length as the long first leg 422 that defines a portion of each of the J-shaped edge formations 420. The leg 612 (it is the left one of the legs of the member 620 that is depicted in FIG. 10, but is the right one of the legs of the member 620 that is used on the opposite side of the door 700) is connected by a right angle bend 633 to a short reach of metal 623 that has an inner end 625 that defines one side of the door opening 610.

The leg 622 is connected by a right angle bend 632 to a short second leg 624 that is of the same length as the second leg 424 that is used in forming each of the J-shaped edge formations 420. The second leg 624 is connected by a right angle bend 636 to a third leg 626 that extends forwardly, paralleling the first leg 622. Because the legs 622, 624, 626 and the right angle bends 632, 634, 636 are for all practical purposes formed so as to be identical to the legs 422, 424, 426 and bends 432, 434, 436 that are employed in each of the J-shaped formations 420, the resulting J-shaped formation is assemblable as shown in FIG. 10 with the adjacent J-shaped formation 420 to form a box-like post structure that is held together by carriage bolts 1050 and nuts 1052, with the bolts 1050 extending through aligned holes that are formed in the parallel legs 422, 622.

Figure 9:
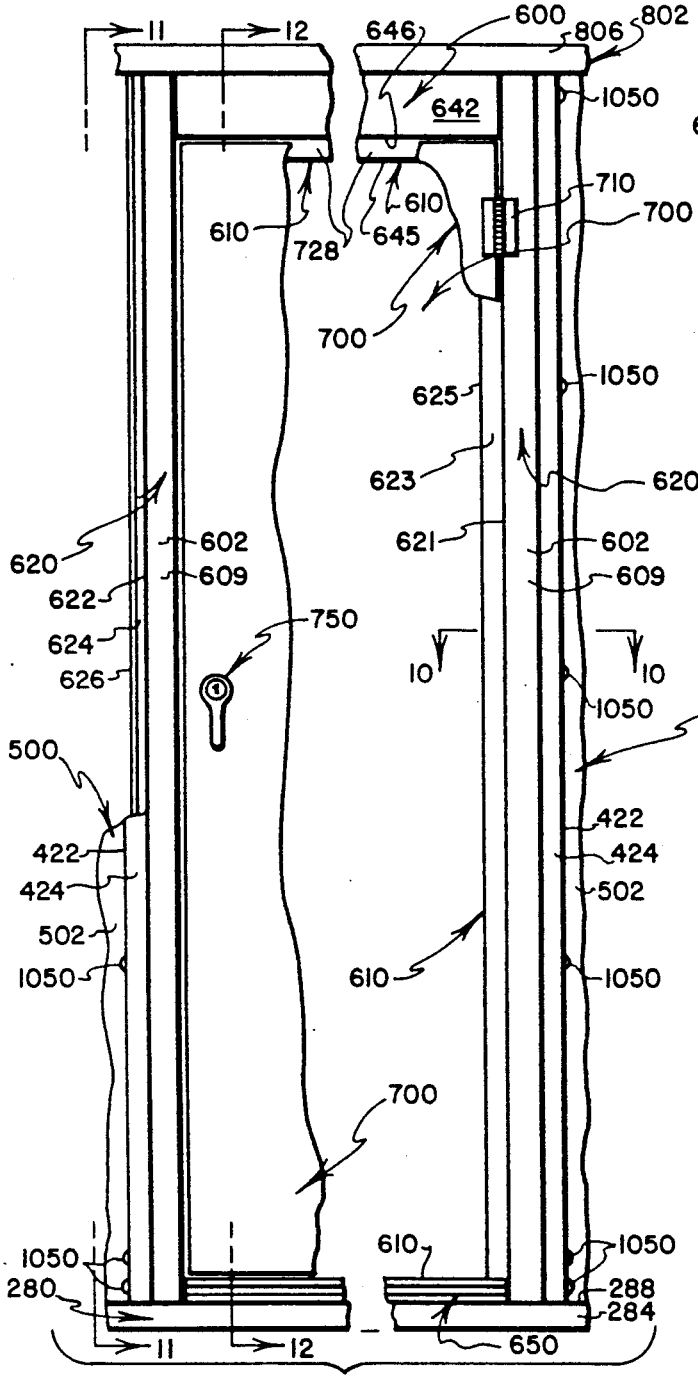
FIG. 9 is a foreshortened side elevational view of selected portions of the front wall and the door of the enclosure.
Figure 12:
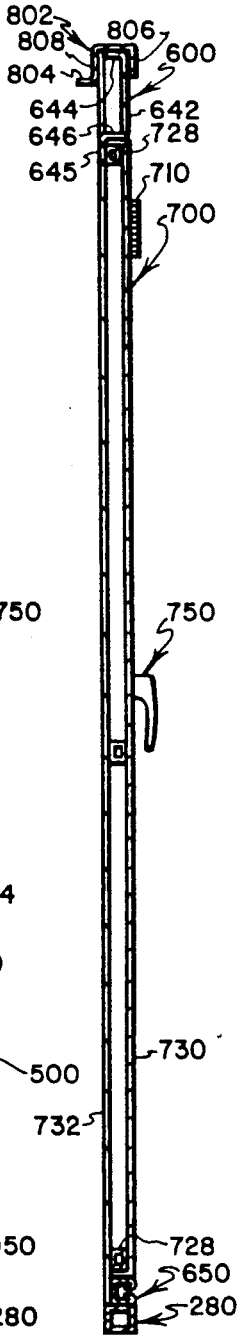
FIG. 12 is a sectional view as seen from a plane indicated by a line 12—12 in FIG. 9.

Referring to FIGS. 9 and 12, the header 640 has something of the configuration of a shallow rectangular pan in that it has a center region 642 that is bounded by inwardly folded edge portions. Referring to FIG. 12, the uppermost of these inwardly folded edges is indicated by the numeral 644, and will be seen to comprise a simple, flat, inwardly extending flange of metal that is overlaid by the cap member 802. At left and right ends of the header 640, equally simple, inwardly turned edges (not shown) are provided and are connected by suitable bolts (not shown) or welds (not shown) to the inwardly extending legs 612 of the left and right uprights 620. The lowermost of the inwardly folded edges is indicated in FIG. 12 by the numeral 646. The inwardly extending edge 646 is bent downwardly at its inner end and terminates, as is indicated by the numeral 645, in a depending surface that defines a portion of the door opening 610.

Figure 4:
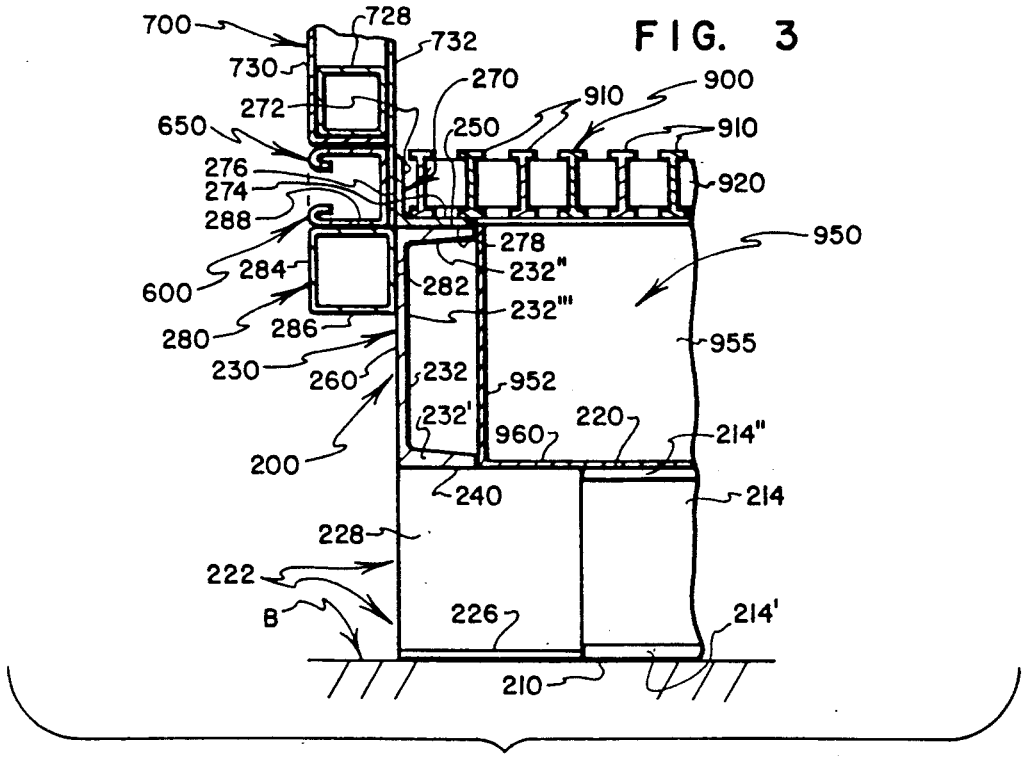
FIG. 4 is a sectional view, on the same scale as FIG. 3, as seen from a plane indicated by a line 4—4 in FIG. 2, with this view showing principally features of the welded base assembly together with lower portions of the door and door frame.

Referring to FIGS. 4, 9 and 12, the footer 650 preferably comprises a framing member that is much like the aforedescribed framing members 1100 except that it has outer dimensions that define a cross-section that is relatively square. A cut-to-length piece of framing stock that is sold by Wesanco, Inc. under the product designation W-210 is quite satisfactory for this use, and offers advantages in that, if its track opening is oriented to face forwardly (as is depicted most clearly in FIG. 4), one end of a suitably configured ramp structure (not shown) can be connected thereto or inserted into the track thereof, as may be suitable for facilitating the smooth movement of containers of hazardous material through the door opening 610.

Referring to FIGS. 4 and 12, the door 700 can be formed in a conventional way as by providing a suitable framework 728 and by welding a pair of front and rear sheets 730, 732 of steel thereto, or can be commercially purchased. Likewise, the character of the lock assembly 750 that is selected to be carried on the door for engaging one or more strikes (not shown) that typically are mounted in conventional fashion on the door panel 600 can be fabricated or purchased as a commercially available unit, incorporating such features and offering features of security as one may elect to provide. In preferred practice, however, a lock assembly that engages a plurality of strikes (not shown) so as to provide plural points of locking engagement between the door 700 and the door panel 600 is preferred.

Referring to FIGS. 23–27, the roof assembly 800 is supported atop the wall assembly 300 by means of a generally U-shaped, downwardly opening cap 802 that extends perimetrically about the upper ends of the wall panels 400, the wall-corner panels 500 and the door panel 600. The roof assembly 800 is formed principally from left and right end panels 810 (and, in embodiments larger than the embodiment 100, for example the embodiment 2100 shown in FIG. 28, the roof assembly 800 includes what are called center panels 820). The cap 802 has an inwardly turned flange 804 that engages opposite ends of a set of tapered perlins 870, one of which is positioned beneath central portions of each of the roof panels 810, 820.

Figure 23:
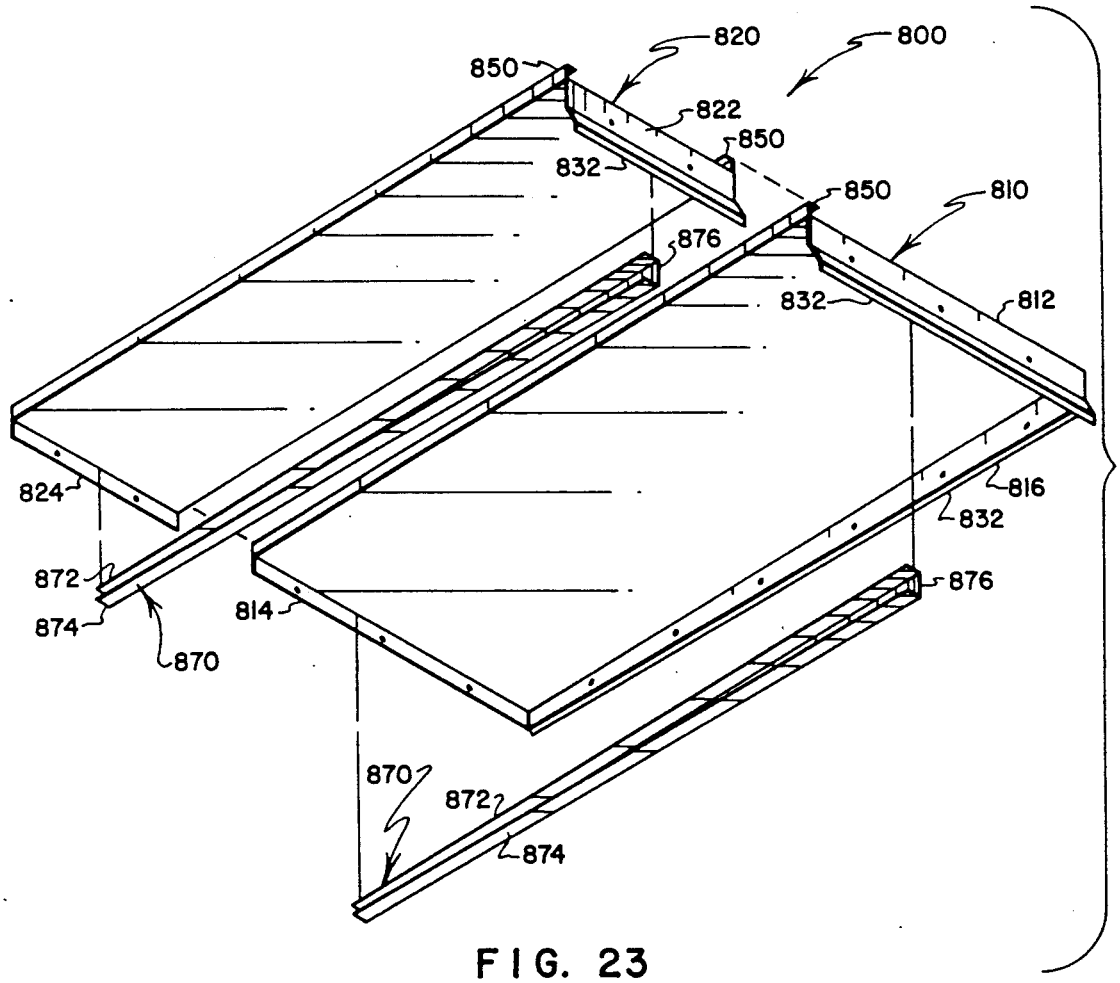
FIG. 23 is an exploded perspective view of portions of the roof assembly.

The wall cap 802 has a depending exterior leg 806 that extends into juxtaposed relationship with front, rear and end depending lips 812, 814, 816 of the end panels 810; and into juxtaposed relationship with front and rear depending lips 822, 824 of the center panels 822 (see FIG. 23). Threaded fasteners, indicated generally by the numerals 830 in FIGS. 24–27, are used to secure these juxtaposed surfaces in proper position—with it being noted that the roof panels 810, 820 slant downwardly from front to rear to drain rain water therefrom. The front depending lips 812, 822 have forwardly projecting bottom portions 832 that serve to divert rain water away from the front walls 302 and the doors 700 of the enclosures 100, 2100, as is seen in FIGS. 1, 24, 27 and 28. Referring to FIG. 25, the depending lips 816 likewise have forwardly projecting bottom portions 832.

Figure 11:
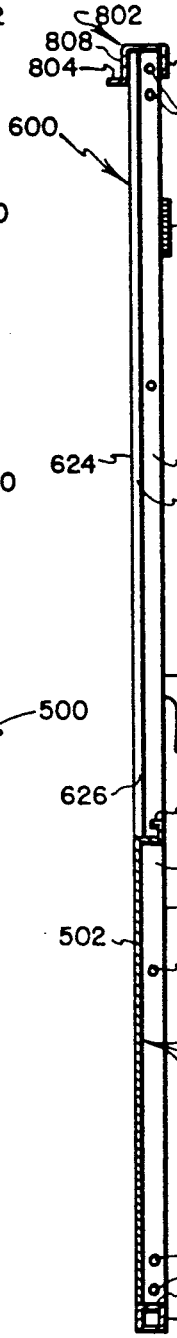
FIG. 11 is a sectional view as seen from a plane indicated by a line 11—11 in FIG. 9.
Figure 25:
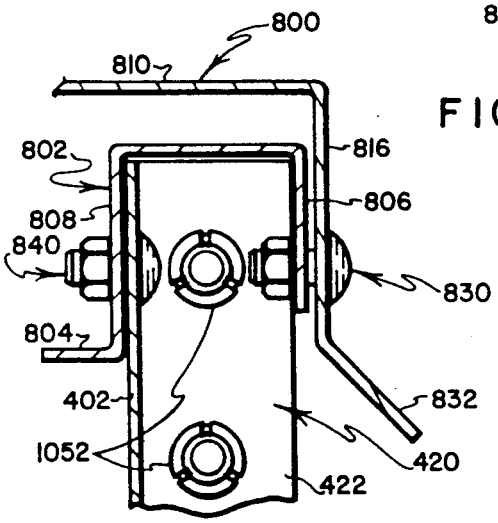
FIGS. 25, 26 and 27 are sectional view as seen from planes indicated by lines 25—25, 26—26 and 27—27 in FIG. 24; and, FIG. 28 is a perspective view showing an alternate embodiment of safety enclosure that is of about twice the size of the enclosure of FIG. 1, and which is formed in a modular manner utilizing an enlarged base and roof assemblies of the general type described, and utilizing wall, wall-corner and door panels of the type illustrated in conjunction with the enclosure of FIG. 1.
Figure 27:
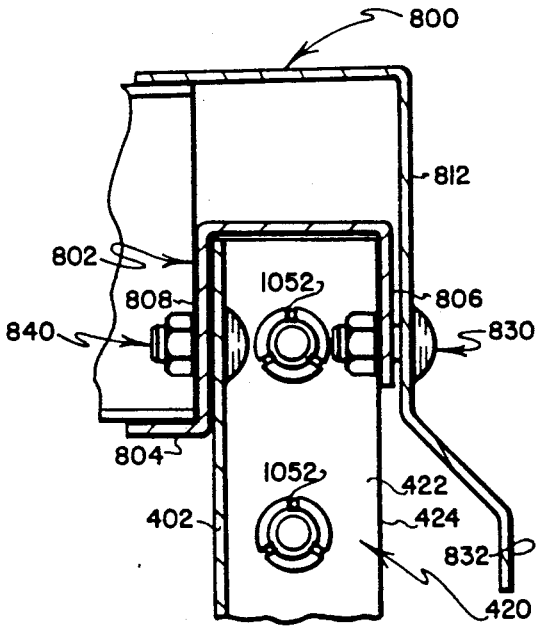
Figure 26:
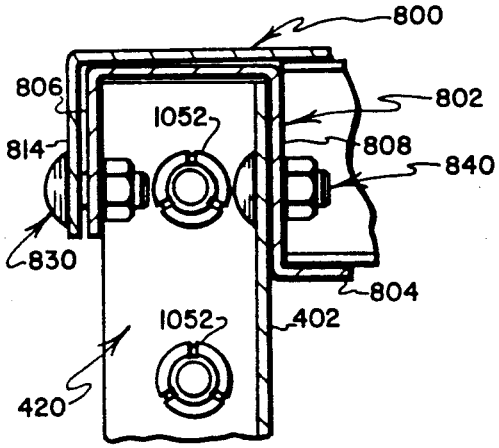

The wall cap 802 has a depending interior leg 808 that extends into juxtaposed relationship with upper end portions of the central regions 402, 502 of the wall and wall-corner panels 400, 500 (see FIGS. 24–27); and that extends into juxtaposed relationship with upright members 620 that form components of the door panels 600 (see FIG. 11). Threaded fasteners, indicated generally by the numerals 840 in FIGS. 25–27, are used to secure these juxtaposed surfaces in proper position.

The end roof panels 810 have one upwardly extending rib 850 for abuttingly engaging a correspondingly configured rib 850 of an adjacent panel 810 or 820. The center roof panels 820 have two upwardly extending ribs 850, one on the left and one on the right, for engaging a correspondingly configured rib 850 of an adjacent panel 810 or 820. Adjacent pairs of the ribs 850 are securely welded together to provide strong, leak-resistant connections therebetween -- whereby the panels 820 and/or 810 that comprise a particular roof assembly 800 are securely connected to define an assembled roof structure.

Figure 24:
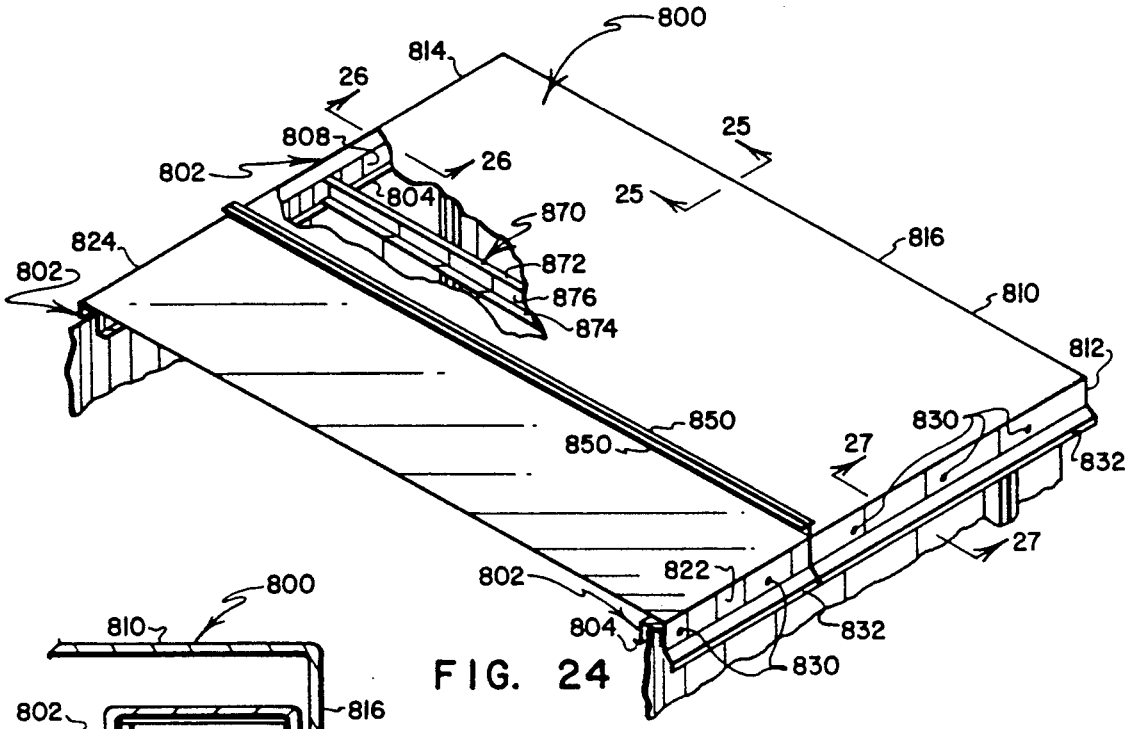
FIG. 24 is a perspective view of portions of upper portions of the enclosure of FIG. 1, with portions thereof broken away.

Referring to FIGS. 23 and 24, the perlins 870 have top and bottom flanges 872, 874 interconnected by upstanding webs 876. The top flange 872 of each of the perlins 830 is welded to center portions of the associated roof panel 810 or 820. Opposite ends of the bottom flange 874 are seated atop the inwardly turned flange 804 of the wall cap 802 and preferably are welded thereto.

Referring to FIGS. 1–4, the grate-like floor 900 has peripheral portions that rest atop the angle iron members 270, and central portions that rest atop the strip of metal 271 that bridges the welded juncture of the upstanding juxtaposed walls 955 of the sumps 950. In preferred practice, the grate-like floor 900 has a series of spaced, elongate, upstanding, beam-like members 910 that are rigidly interconnected by transversely extending bar-like members 920, all of which are formed from reinforced glass fiber and resin. Grate-like floor panels of the preferred type are commercially available from Aligned Fiber Composites Division of Morrison Molded Fiber Glass Company, Chatfield, Minn. 55923, are referred to by the registered trademark DURA-DEK, and are referred to as being of the I-Bar 1½" type. The specific type of floor structure that is purchased for use in the enclosure 100 does not form a part of the present invention. As those who are skilled in the art will readily understand, a wide variety of types of commercially available floor structures can be used in the safety enclosure 100; however, suitable strength and chemical resistance should be paramount among the considerations taken into account in the selection.

As will be apparent from the foregoing discussion taken in conjunction with the accompanying drawings and the claims that follow, the present invention provides a novel and improved safety enclosure that is rendered particularly rugged, strong and sturdy by the use of framing members 1000 or 1100 that are carried in inwardly facing recesses 430 that are defined by abuttingly engaged J-shaped edge formations 420 that have outwardly projecting legs 422 that extend alongside side portions 1002, 1102—and through which a plurality of bolts 1050 extend so as to be clamped in place by nuts 1052 to form columnar structures at the junctures of adjacent ones of the wall and wall-corner panels 400, 500, with these post-like columns being provided at frequent intervals about the periphery of the wall assembly 300.

The use of both angle iron supports 270 and square tubular supports 280 to engage and connect with bottom portions of the wall and wall-corner panels 400, 500 provides especially effective supports and rigid connections for lower end regions of the panels 400, 500. The post-like columnar supports discussed above rest atop the uppermost surface 288 of the tubular supports 280; and, threaded fasteners 1050 extend through aligned holes that are formed in the upwardly extending flanges 272 of the angle iron supports 270 and in central portions 402, 502 of the wall and wall-corner panels 400, 500 to securely clamp the central portions 402, 502 into engagement with the vertically extending, outwardly facing surfaces 276 of the angle iron supports 270.

The provision of spaces 271 between adjacent ones of the angle iron supports 270 helps to provide the enclosures 100, 2100 with an important degree of versatility in assuring that, even after the enclosures 100, 2100 have been duly installed, if it is desired to substitute one of the framing members 1000 for one of the framing members 1100 (or vice versa), or if some different sort of framing member (not shown) is desired to be substituted for one or more of the installed framing members 1000, 1100, the installed framing member can be released and removed from its associated recess 430 simply by removing the bolts 1050. Removal of the bolts 1050 from a one of the wall panel junctures enables the associated framing member 1000 or 1100 to be slid forwardly at its bottom end and dropped downwardly a bit to effect its removal from within the confines of the wall cap 802 so that the process of installing a substitute framing member can be effected by reversing this process and again installing the bolts 1050 and clamping the nuts 1052 into place.

Other aspects of the present invention reside in various combinations of the features that have been described above, that have been illustrated in the drawings, and/or that are more fully brought out in the claims that follow. Included are method features, by which safety enclosures such as have been described herein can be erected as by providing the described component parts and assembling them as has been described.

Although the invention has been described in its preferred form with a certain degree of particularity, it is understood that the present disclosure of the preferred form has been made only by way of example, and that numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A safety storage enclosure for housing containers of hazardous material and providing sump-type secondary containment for receiving spillage and leakage of materials from containers that are housed within the enclosure, comprising:

a) base assembly means including a welded assembly of steel components for defining a generally rectangular structure that has a lower stilt portion, a central containment portion, and an upper wall support portion, wherein:

i) the lower least a pair of structural steel members having first downwardly facing surface means for engaging a generally horizontal surface atop which the safety enclosure is to be installed, having first upwardly facing surface means for engaging and supporting the central containment portion, and having first web means for connecting the first downwardly facing surface means and the first upwardly facing surface means so as to position the first upwardly facing surface means in a first generally horizontal plane that is spaced above the generally horizontal surface;

ii) the central containment portion includes generally rectangular frame means that includes a pair of front and rear members, and a pair of end members that are arranged end-to-end to define a generally rectangular structure that has one end of each of the end members welded to a separate one of the opposed ends of the front member, and that has the other end of each of the end members welded to a separate one of the opposed ends of the rear member, and with the front, rear and end members of the rectangular frame means cooperating to define:

A) second downwardly facing surface means for being positioned atop and for being securely connected to the first upwardly facing means to support the generally rectangular frame means in a generally horizontally extending attitude;

B) second upwardly facing means extending in a second generally horizontal plane located in spaced relationship to and above the first generally horizontal plane;

C) second web means for connecting the second downwardly facing surface means and the second upwardly facing surface means, with the second web means having an outer surface that extends substantially continuously about and defining the outer perimeter of the generally rectangular frame means;

iii) the central containment portion also includes generally rectangular sump means including one or more generally rectangular sumps arranged to effectively define an upwardly opening catch basin that extends in an end-to-end direction substantially the entire distance between the front and rear members, and in a front-to-rear direction substantially the entire distance between the end members so as to substantially fill the space that is surrounded by the generally rectangular frame means;

iv) the upper wall support portion includes first wall support means rigidly connected to the generally rectangular frame means and extending upwardly from near the intersection of the outer surface and the second upwardly facing surface of the generally rectangular frame means for being connected to lower end regions of the wall means, and second wall support means rigidly connected to the generally rectangular frame means and extending outwardly from near said intersection for defining an upwardly facing support surface that extends substantially continuously about the perimeter of the generally rectangular frame means;

b) wall means including an assembly of relatively flat wall panels, relatively L-shaped corner-wall panels, and at least one door frame panel, with said panels extending substantially vertically from lower portions thereof that are connected to said upper wall support portion of said base assembly to upper portions thereof that have top surfaces that extend in a third generally horizontal plane located a substantial distance above the second generally horizontal plane, and with the wall means defining a substantially continuous wall structure that wraps about the perimeter of said generally rectangular structure so as to define a front wall, a rear wall, and a pair of opposed end walls, with the front wall including at least one door frame panel;

c) roof means including a roof structure for connection to said upper portions for defining a roof that substantially continuously overlies the interior space that is defined between the front and rear walls, and between the opposed end walls;

d) grate-type floor means supported by said base means and extending substantially horizontally atop the sump means and substantially continuously within the interior space that is defined between front and rear walls, and between the opposed end walls;

e) door means connected to the door frame panel and being movable relatively thereto for selectively controlling access to said interior space through a door opening that is defined at least in part by the door frame panel;

f) said relatively flat wall panels include at least one "standard" flat wall panel that is formed from a single, generally rectangular sheet of steel that has opposed side edge portions extending parallel to the length thereof, that has opposed bottom and top edge portions bordering the width thereof, and that has generally flat central portions that extend substantially continuously between the opposed side edge portions and between the opposed bottom and top edge portions;

g) said relatively L-shaped corner-wall panels include at least one "standard" L-shaped corner wall panel that is formed from a single, generally rectangular sheet of steel that has opposed side edge portions extending parallel to the length thereof, that has opposed bottom and top edge portions bordering the width thereof, and that has central portions including a pair of generally flat central portions that each extend from a separate one of the side edge portions toward a central location where a substantially right angle bend is formed along a locus that substantially parallels the opposed side edge portions thereof;

h) said wall means includes at least a pair of adjacently positioned flat and/or L-shaped panels of the aforedescribed "standard" types that are arranged to extend vertically edge-to-edge with side edge portions thereof in abutting engagement along substantially the full lengths thereof, with the abutting side edge portions including complementary substantially J-shaped formations, with each of the J-shaped formations being defined by a relatively long first leg and relatively shorter second and third legs, and wherein:

i) each of the first, second and third legs is formed as an integral part of its associated wall panel, and each such leg is defined by a substantially flat band of vertically extending sheet metal that, when viewed in horizontal cross-section, has the appearance of an elongate element with parallel sides that extend between a pair of opposite end regions;

ii) each relatively long first leg is connected at one end region thereof to adjacent central portions of its associated panel by a substantially right angle bend that causes the first leg to extend outwardly from the plane of said adjacent central portions;

iii) each second leg is connected at one end region thereof to the other end region of its associated first leg by a substantially right angle bend that causes the second leg to extend in an outer plane that substantially parallels the plane of said adjacent central portions but at a location spaced outwardly therefrom;

iv) each third leg is connected at one end region thereof to the other end region of its associated second leg by a substantially right angle bend that causes the third leg to extend inwardly from the outer plane in a direction that parallels the associated first leg but at a distance spaced therefrom;

v) each third leg has its other end region of the third leg located between the outer plane and the plane of said adjacent central portions of its associated panel;

vi) said abutting engagement along substantially the full lengths of said pair of adjacently positioned panels is provided by said third legs thereof being arranged to extend in abutting engagement along substantially their full lengths; and, vii) such central portions of each of said pair of adjacently positioned panels as are located near the abutting side edge regions are arranged to extend in a common plane, whereby the first legs of the J-shaped formations cooperate to define substantially parallel sides of a vertically extending "groove" located between adjacent central portions of said panels;

i) groove insert means including at least one elongate member for insertion into said vertically extending "groove" is provided to bridge the juncture between the abutted third legs;

j) aligned holes are formed through selected portions of the J-shaped formations and through the elongate member; and, k) fastener means for extending through the aligned holes and for clamping the abuttingly connected pair of adjacently positioned panels are provided to secure the connection between the adjacently positioned panels.

2. The safety storage enclosure of claim 1 wherein said one or more generally rectangular sumps includes at least one generally rectangular, upwardly opening vessel that is formed from a single piece of steel sheet that provides a seamless, horizontally extending bottom wall of generally rectangular shape together with four seamless upstanding side walls arranged in opposed pairs to border opposed pairs of edge regions of the generally rectangular bottom wall, with each of the upstanding side walls being connected to a separate one of the edge regions by a separate, substantially right angle bend, and with the vessel having four welded corner junctures that are formed by securely welding adjacent portions of the upstanding side walls together at locations near the four corners of the generally rectangular bottom wall.

3. The safety storage enclosure of claim 2 wherein:

a) the secondary upwardly facing means that forms a part of said generally rectangular frame means has first and second opposed pairs of secondary upwardly facing edge portions that closely surround the area that is occupied by the generally rectangular sump means; and, b) the four upstanding side walls include a first pair of opposed side walls extending along opposed edge regions of the generally rectangular bottom wall, the opposed side walls have top edge regions that extend substantially parallel to the plane of the generally rectangular bottom wall, and said top edge regions are welded substantially continuously along their lengths to said first opposed pair of said second upwardly facing means.

4. The safety storage enclosure of claim 3 wherein:

a) said one or more generally rectangular sumps includes a side by side array of a plurality of said upwardly opening vessels, with the array including a first of said vessels at one end thereof and a second of said vessels at the opposite end thereof, and with adjacent ones of said vessels having juxtaposed upstanding side walls with juxtaposed top edge regions thereof extending in substantially the same horizontal plane; and, b) said juxtaposed top edge regions are welded substantially continuously together along their lengths.

5. The safety storage enclosure of claim 4 wherein at least one of said welded juxtaposed top edge regions of said juxtaposed side walls is capped by a strip of metal that underlies portions of and assists in supporting said grate-type floor means.

6. The safety storage enclosure of claim 1 wherein the lower stilt portion includes a pair of channel-shaped structural steel members of generally C-shaped cross section that are positioned to directly underlie the pair of end members of the generally rectangular frame means, with said pair of channel-shaped members having their C-shaped cross-sections opening toward each other so as to position their smooth upstanding web surfaces at opposite ends of the lower stilt portion.

7. The safety storage enclosure of claim 6 wherein the lower stilt portion additionally includes a separate additional channel-shaped structural steel member for underlying and supporting central portions of each separate one of said vessels that form said sump means, with each such additional member extending substantially parallel to said channel-shaped members of C-shaped cross-section, with each such additional member having opposite end regions and having lengths that substantially equal the lengths of the pair of end members of the generally rectangular frame means.

8. The safety storage enclosure of claim 7 wherein:

a) said sump means includes at least two sumps, and said additional channel-shaped structural steel members are arranged such that at least one pair of adjacent ones of the additional channel-shaped members has C-shaped cross-sections opening toward each other;

b) one end region of each of the adjacent pair of additional members is connected by first interconnection means; and, c) the other end region of each of the adjacent pair of additional members is connected by second interconnection means.

9. The safety storage enclosure of claim 1 wherein the second upwardly facing means that forms a part of said central containment portion of the base assembly has an inner edge portion that extends substantially continuously along and in juxtaposed relationship to such sumps as define portions of said sump means, and a substantially continuous weld is formed therealong.

10. The safety storage enclosure of claim 9 wherein said second web means defines the height of said central containment portion as being within the range of at least about five inches high, the depth of such sumps as define portions of said sump means is approximately equal to said height, and said rectangular frame surrounds and protectively encloses said sumps.

11. The safety storage enclosure of claim 10 wherein the second downwardly facing means that forms a part of said central containment portion of the base assembly has an inner edge portion that extends substantially continuously along and in juxtaposed relationship to lower portions of such sumps as define portions of said sump means, and said inner edge portion is welded to such lower portions at spaced locations therealong.

12. The safety storage enclosure of claim 1 wherein said first wall support means includes angle iron means having a first leg thereof resting atop and being rigidly connected to the second upwardly facing means that is defined by the rectangular structure, with a second leg thereof extending substantially vertically upwardly from the second upwardly facing means for defining an outwardly facing surface that extends in substantially the same plane as said outer surface, with said outwardly facing surface extending into engagement with central portions of the lower end regions of said wall panels and said corner-wall panels.

13. The safety storage enclosure of claim 12 additionally including threaded fastener means extending through aligned holes formed through the second vertically extending leg of the angle iron means and through central portions of lower end regions of said wall panels and said wall-corner panels for securely connecting such panels to the base assembly means.

14. The safety storage enclosure of claim 12 wherein the angle iron means includes a plurality of pieces of angle iron that are welded to the second upwardly facing means in the manner described above, but with a space being provided between end regions of adjacent ones of the angle iron means within the vicinity of the lower end regions of said vertically extending groove for enabling the lower end region of said groove insert means to move into and out of said groove.

15. The safety storage enclosure of claim 12 wherein said grate-type floor means has peripheral portions thereof that extending into overlying engagement with said first leg of the angle iron means for being supported by the base assembly means.

16. The safety storage enclosure of claim 1 wherein at least a portion of the grate-type floor means comprises an assembly of resin and glass fiber material that provides a smooth upwardly facing support surface that is perforated so as to permit liquid to flow downwardly therethrough under the influence of the force of gravity and into the sumps.

17. The safety storage enclosure of claim 1 wherein said second wall support means is defined, at least in part, by a length of square tubular stock that has an inwardly facing surface that extends in juxtaposition with the second upwardly facing surface of the generally rectangular frame means, and that has an upwardly facing surface that defines at least a portion of said upwardly facing support surface that extends substantially continuously about the perimeter of the generally rectangular frame means.

18. The safety storage enclosure of claim 17 wherein said square tubular stock extends substantially continuously about the perimeter of the generally rectangular frame means to define said upwardly facing support surface and to position said upwardly facing support surface such that it extends in substantially the same plane as said second upwardly facing means.

19. The safety storage enclosure of claim 18 wherein the door panel means includes sill means extending along and defining the bottom of the door opening, with the sill means being formed at least in part from an elongate member that is positioned atop such portions of the upwardly facing support surface as underlie the door opening.

20. The safety storage enclosure of claim 19 wherein the sill means is formed from a hollow, elongate member that is adapted for connection to a suitably configured ramp in that the hollow, elongate member defines a forwardly-facing opening for receiving ramp connection means therein.

21. The safety storage enclosure of claim 1 wherein:

a) the wall panels and the wall-corner panels used in forming the wall means all are of substantially the same height; and, b) the door panel includes left and right elongate uprights extending vertically along left and right sides of the door opening, with each of the uprights having a height that is substantially equal to that of the wall panels and wall-corner panels.

22. The safety storage enclosure of claim 21 wherein the roof means includes elongate cap means of generally U-shaped, downwardly opening cross-section for being positioned atop the wall panels, atop the wall-corner panels, and atop the left and right uprights, with upper end portions of the wall panels, the wall-corner panels and the left and right uprights extending into the downwardly-opening U-shaped formation of the cap means.

23. The safety storage enclosure of claim 22 additionally including threaded fastener means for extending through aligned holes formed in portions of the upper end regions of selected of the wall panels, the wall-corner panels and the left and right uprights, and through the wall cap means, for securely connecting said selected of the wall panels, the wall-corner panels and the left and right uprights to the cap means.

24. The safety storage enclosure of claim 22 wherein portions of the roof structure depend into juxtaposed relationship with portions of the cap means, and means are provided for forming rigid connections therebetween at spaced locations extending about the periphery of the roof structure.

25. The safety storage enclosure of claim 24 wherein the roof structure includes at least a pair of left and right end panels that each are formed from a separate piece of steel sheet material, that have central portions that bridge at least portions of the interior of the enclosure to define at least portions of a roof therefore, and that have depending edge formations that are connected integrally with the central portions as by bends formed in the steel sheet material, with said edge formations defining said depending roof portions.

26. The safety storage enclosure of claim 25 wherein each of the left and right end panels has upwardly extending flange means for extending across portions of the interior of the enclosure, and for being brought into abutting engagement and rigidly connected so as to define substantially a complete roof for a relatively small safety enclosure.

27. The safety storage enclosure of claim 25, wherein:

a) each of the left and right end panels has upwardly extending flange means for extending across portions of the interior of the enclosure;

b) the roof means also includes center panel means for defining portions of the roof means at locations between the left and right end panels;

c) the center panel means has at least a pair of opposed, left and right, upwardly extending flange formations that extend across portions of the interior of the enclosure at locations between the left and right end panels;

d) the upwardly extending flange means of the left end panel extends in juxtaposed relationship with and is rigidly connected to the left flange formation of the center panel means; and, e) the upwardly extending flange means of the right end panel extends in juxtaposed relationship with and is rigidly connected to the right flange formation of the center panel means;

f) whereby a substantially complete roof is defined by the rigidly connected combination of the left and right end panels with the center panel means.

28. The safety storage enclosure of claim 27 wherein the rigid connections that are formed between juxtaposed flange portions of the end panels and the center panel means that form the roof is provided by welding.

29. The safety storage enclosure of claim 1 wherein the "standard" L-shaped corner panels are each of substantially identical configuration.

30. The safety storage enclosure of claim 29 wherein the "standard" flat wall panels are each of substantially identical configuration, and each has a predetermined width.

31. The safety storage enclosure of claim 30 wherein each of the door panels is substitutable in place of a given number of said "standard" flat wall panels of predetermined width, whereby one or more door openings can be located in the wall means of the enclosure as may be most appropriate to the use that is being made of the enclosure.

32. The safety storage enclosure of claim 1 wherein:

a) the wall panels and the wall-corner panels used in forming the wall means all are of substantially the same height;

b) the door panel includes left and right elongate uprights extending vertically along left and right sides of the door opening, with each of the uprights having a height that is substantially equal to that of the wall panels and wall-corner panels;

c) the door panel also includes elongate header means for extending horizontally between the left and right uprights, with the header having left and right end regions, with the left end region being rigidly connected to the left upright, and with the right end region being rigidly connected to the right upright.

33. The safety storage enclosure of claim 32 wherein the left and right elongate uprights are substantially identical in character except that each takes a form that presents the mirror image of the other.

34. The safety storage enclosure of claim 33, wherein:

a) each of the left and right uprights is formed from a single, generally rectangular sheet of steel that has first and second opposed side edge portions extending parallel to the length thereof, that has opposed bottom and top edge portions extending parallel to the width thereof, and that has generally flat central portions that extend substantially continuously between the opposed first and second side edge portions and between the opposed bottom and top edge portions;

b) each of the first opposed side edge portions includes structure that assists in defining at least a portion of the door opening; and, c) each of the second opposed side edge portions defines a J-shaped formation that includes a relatively long first leg and relatively shorter second and third legs, and wherein:

i) each of the first, second and third legs is defined by a substantially flat band of vertically extending sheet metal that, when viewed in horizontal cross-section, has the appearance of an elongate element with parallel sides that extend between a pair of opposite end regions;

ii) each relatively long first leg is connected at one end region thereof to the flat central portions of the upright by a substantially right angle bend that causes the first leg to extend inwardly from the plane of the adjacent flat central portions;

iii) each second leg is connected at one end region thereof to the other end region of its associated first leg by a substantially right angle bend that causes the second leg to extend in an inner plane that substantially parallels the plane of the adjacent flat central portions but at a location spaced outwardly therefrom;

iv) each third leg is connected at one end region thereof to the other end region of its associated second leg by a substantially right angle bend that causes the third leg to extend outwardly from the inner plane in a direction that parallels the associated first leg but at a distance spaced therefrom; and, v) each third leg has its other end region of the third leg located between the inner plane and the plane of the adjacent flat central portions.

35. The safety storage enclosure of claim 34 wherein, when the door panel is assembled with selected ones of said wall and wall-corner panels to define said wall assembly, at least a selected one of the left and right upright members has its J-shaped formation overlapped and abuttingly engaged with the J-shaped formation of an adjacent one of said wall and wall-corner panels such that:

a) the second legs of the overlapped J-shaped formations extend in spaced, overlapping relationship; and, b) the first leg of each of the overlapped J-shaped formations extends parallel to and abuttingly engages the third leg of the other of the overlapped J-shaped formations.

36. The safety storage enclosure of claim 35 wherein the aforedescribed abutting engagement between the overlapped J-shaped formations is secured and maintained as by providing threaded fasteners that extend through aligned holes formed in the first legs of each of the J-shaped formations, and nuts are tightened in place on the threaded fasteners to clamp the overlapped J-shaped formations together in the manner aforedescribed.

37. The safety storage enclosure of claim 1 wherein said fastener means includes headed, threaded bolts that are inserted through said aligned holes, and nuts that are tightened in place on the threaded fasteners to clamp the abuttingly connected pair of adjacently positioned panels together.

38. The safety storage enclosure of claim 37 wherein said headed, threaded bolts include carriage bolts, and wherein said nuts are of a tamper-resistant type that requires a relatively non-conventional tool to drivingly engage outer surface portions of the nuts to tighten or loosen them on their associated carriage bolts.

39. The safety storage enclosure of claim 1 wherein each of the wall panels and each of the wall-corner panels is formed as a one-piece part as by cutting its layout from a sheet of steel of approximately 12 gage thickness, and by folding the cut-out so as to form the J-shaped edge formations and the right angle bends that give the L-shaped wall-corner panels their characteristic shape.

40. The safety storage enclosure of claim 1 wherein the groove insert means is a U-shaped member formed from steel sheet stock of about 12 gage thickness, having opposed sides that extend, at least in part, in spaced, parallel planes, and having a pair of right angle bends that connect the opposed sides with a central portion that extends between and rigidly interconnects the opposed sides, with the opposed sides being spaced apart by a distance that will permit the U-shaped member to be inserted into the vertically extending "groove" that is defined where the first legs of a pair of abutting J-shaped formations intersect with their adjacent central panel portions.

41. The safety storage enclosure of claim 40 wherein the central portion of the U-shaped member is arranged and configured so that, when the U-shaped member is duly installed in the "groove," the central portion of the U-shaped member extends substantially in a common plane with central portions of the associated wall and/or wall-corner panels.

42. The safety storage enclosure of claim 40 wherein the U-shaped member is inserted into the "groove" in a manner such that its opposed sides extend along the first legs of the J-shaped formations that cooperate to define the "groove," and in a manner such that the central portion of the U-shaped member is positioned internally of the "groove" at a location that is relatively near inner end portions of the third legs of the J-shaped formations.

43. The safety storage enclosure of claim 42 wherein the opposed sides of the U-shaped member have inwardly turned edge portions that cooperate to narrow the space between the opposed sides at a location that is spaced from the central portion of the U-shaped member, whereby a space is defined between the inwardly turned edge portions and the central portion of the U-shaped member into which an appropriately configured fastener can be inserted and positioned to extend in a manner that bridges and engages the inwardly turned edge portions.

44. The safety storage enclosure of claim 43 additionally including at least one fastener positioned in the space that is defined between the inwardly turned edge portions and the central portion of the U-shaped member.

45. The safety storage enclosure of claim 44 additionally including a compression coil spring interposed between the positioned fastener and nearby central portions of the U-shaped member for biasing the fastener into engagement with the inwardly turned edge portions.

46. The safety storage enclosure of claim 45 wherein the fastener is provided with at least one formation for engaging at least one of the inwardly turned edge formations for assisting in maintaining the orientation of the fastener.

47. The safety storage enclosure of claim 44 additionally including a shelf bracket that is connected to the fastener.

48. The safety storage enclosure of claim 44 additionally including support bracket means connected to the fastener for supporting tubular stock such as pipe and electrical conduit.

49. The safety storage enclosure of claim 1 wherein the groove insert means is an elongate U-shaped member that has a lower end region that engages the upwardly facing support surface that is defined by the second wall support means.

50. A joint that connects a pair of adjacent wall panels of a safety storage enclosure for storing hazardous material, wherein:

a) each of the adjacent wall panels has a J-shaped formation extending along a vertically extending edge portion thereof, with the J-shaped formation of each wall panel being integrally connected with adjacent central portions of its associated wall panel, and with the adjacent central portions of each of the adjacent wall panels extending in substantially a common plane;

b) each of the J-shaped formations is defined by a relatively long first leg and by relatively shorter second and third legs, and wherein:

i) each of the first, second and third legs is formed as an integral part of its associated wall panel, and each such leg is defined by a substantially flat band of vertically extending sheet metal that, when viewed in horizontal cross-section, has the appearance of an elongate element with parallel sides that extend between a pair of opposite end regions;

ii) each relatively long first leg is connected at one end region thereof to adjacent central portions of its associated panel by a substantially right angle bend that causes the first leg to extend outwardly from the plane of said adjacent central portions;

iii) each second leg is connected at one end region thereof to the other end region of its associated first leg by a substantially right angle bend that causes the second leg to extend in an outer plane that substantially parallels the plane of said adjacent central portions but at a location spaced outwardly therefrom;

iv) each third leg is connected at one end region thereof to the other end region of its associated second leg by a substantially right angle bend that causes the third leg to extend inwardly from the outer plane in a direction that parallels the associated first leg but at a distance spaced therefrom;

v) each third leg has its other end region of the third leg located between the outer plane and the plane of said adjacent central portions of its associated panel;

vi) said abutting engagement along substantially the full lengths of said pair of adjacently positioned panels is provided by said third legs thereof being arranged to extend in abutting engagement along substantially their full lengths; and, vii) such central portions of each of said pair of adjacently positioned panels as are located near the abutting side edge regions are arranged to extend in a common plane, whereby the first legs of the J-shaped formations cooperate to define substantially parallel sides of a vertically extending "groove" located between adjacent central portions of said panels;

c) groove insert means including at least one elongate member of having opposed, interconnected side surfaces is inserted into said "groove" that is defined between the first legs such that the opposed side surfaces each engage a separate one of the first legs, with the elongate member serving to bridge the juncture between the abutted third legs;

d) aligned holes are formed through selected portions of the J-shaped formations and through the elongate member; and, e) fastener means is provided for extending through the aligned holes and for clamping the abuttingly connected pair of adjacently positioned panels are provided to secure the connection between the adjacently positioned panels.

51. The safety storage enclosure of claim 50 wherein said fastener means includes headed, threaded bolts that are inserted through said aligned holes, and nuts that are tightened in place on the threaded fasteners to clamp the abuttingly connected pair of adjacently positioned panels together.

52. The safety storage enclosure of claim 50 wherein the groove insert means is a U-shaped member formed from steel sheet stock of about 12 gage thickness, having opposed sides that extend, at least in part, in spaced, parallel planes, and having a pair of right angle bends that connect the opposed sides with a central portion that extends between and rigidly interconnects the opposed sides, with the opposed sides being spaced apart by a distance that will permit the U-shaped member to be inserted into the vertically extending "groove" that is defined where the first legs of a pair of abutting J-shaped formations intersect with their adjacent central panel portions.

53. The safety storage enclosure of claim 52 wherein the central portion of the U-shaped member is arranged and configured so that, when the U-shaped member is duly installed in the "groove," the central portion of the U-shaped member extends substantially in a common plane with central portions of the associated wall and/or wall-corner panels.

54. The safety storage enclosure of claim 52 wherein the U-shaped member is inserted into the "groove" in a manner such that its opposed sides extend along the first legs of the J-shaped formations that cooperate to define the "groove," and in a manner such that the central portion of the U-shaped member is positioned internally of the "groove" at a location that is relatively near inner end portions of the third legs of the J-shaped formations.

55. The safety storage enclosure of claim 54 wherein the opposed sides of the U-shaped member have inwardly turned edge portions that cooperate to narrow the space between the opposed sides at a location that is spaced from the central portion of the U-shaped member, whereby a space is defined between the inwardly turned edge portions and the central portion of the U-shaped member into which an appropriately configured fastener can be inserted and positioned to extend in a manner that bridges and engages the inwardly turned edge portions.

56. The safety storage enclosure of claim 55 additionally including at least one fastener positioned in the space that is defined between the inwardly turned edge portions and the central portion of the U-shaped member.

57. The safety storage enclosure of claim 56 additionally including a compression coil spring interposed between the positioned fastener and nearby central portions of the U-shaped member for biasing the fastener into engagement with the inwardly turned edge portions.

58. The safety storage enclosure of claim 57 wherein the fastener is provided with at least one formation for engaging at least one of the inwardly turned edge formations for assisting in maintaining the orientation of the fastener.

* * * * *

UNITED STATES PATENT AND TRADEMARK OFFICE
CERTIFICATE OF CORRECTION

PATENT NO. : 5,052,569

DATED : October 1, 1991

INVENTOR(S) : Clinton T. Cooper

It is certified that error appears in the above-identified patent and that said Letters Patent is hereby corrected as shown below:

On title page, item [56], the following should be added;

U.S. PATENT DOCUMENTS

| | | | |
|---|---|---|---|
| 4,875,595 | 10/1989 | Van Valkenburg | 220/1.5 |
| 4,361,232 | 11/1982 | Olmsted | 206/386 |
| 4,015,715 | 04/1977 | Kelf | 206/386X |
| 3,623,631 | 11/1971 | Ford | 220/69 |
| 2,547,112 | 04/1951 | Daniels | 217/69 |
| 2,073,990 | 03/1937 | Koch | 220/1.5 |

FOREIGN PATENT DOCUMENTS

| | | | |
|---|---|---|---|
| 2,717,396 | 08/1978 | Fed. Rep. of Germany | 220/1C |
| 7,414,833 | 11/1974 | Netherlands | 206/386 |
| 2,156,313 | 10/1985 | United Kingdom | 206/386 |

UNITED STATES PATENT AND TRADEMARK OFFICE

CERTIFICATE OF CORRECTION

PATENT NO. : 5,052,569

DATED : October 1, 1991

INVENTOR(S) : Clinton T. Cooper

It is certified that error appears in the above-identified patent and that said Letters Patent is hereby corrected as shown below:

Title page, item [56], the following should be added;

OTHER PRIOR ART

Allegheny "TAMPRUF" brochure, 4 pages, Allegheny Bolt & Screw Corp., Valley Stream, NY 11580, copyright date 1988

Wesanco, Inc. Catalog Pages 14,20,22,36 & front cover, Catalog No. W-1002, Wesanco, Inc., Warren, OH 44483, undated DURADEK Fiberglass Walkway and Platform Systems catalog, 8 pages, Aligned Fiber Composites Div. of Morrison Molded Fiber Glass Co., Chatfield, MN 55923

Shields Mfg. Co., Inc., 3 page brochure, May 15, 1989, Hazardous Material Storage Facilities, Models #300 thru #800, Oxnard, CA 93030

Chem-Stor, Inc., 1 page brochure, January, 1989, Chemical Storage Lockers Model A & B, Gilroy, CA 95021

Signed and Sealed this

Thirteenth Day of July, 1993

*Attest:*

Michael K. Kirk

MICHAEL K. KIRK

*Attesting Officer*

*Acting Commissioner of Patents and Trademarks*